US006750787B2

(12) United States Patent
Hutchinson

(10) Patent No.: US 6,750,787 B2
(45) Date of Patent: Jun. 15, 2004

(54) OPTRONIC SYSTEM FOR THE MEASUREMENT OF VEHICLE TRAFFIC

(76) Inventor: Herbert A. Hutchinson, 2075 Channelford Rd., Westlake Village, CA (US) 91361

( * ) Notice: Subject to any disclaimer, the term of this patent is extended or adjusted under 35 U.S.C. 154(b) by 191 days.

(21) Appl. No.: 09/805,691

(22) Filed: Mar. 13, 2001

(65) Prior Publication Data

US 2002/0000921 A1 Jan. 3, 2002

Related U.S. Application Data

(60) Provisional application No. 60/190,080, filed on Mar. 17, 2000.

(51) Int. Cl.[7] ..... G08G 1/04

(52) U.S. Cl. ..... 340/942; 340/933; 340/935; 340/936; 701/119

(58) Field of Search ..... 340/933, 934, 340/935, 936, 942, 330; 701/117, 118, 119

(56) References Cited

U.S. PATENT DOCUMENTS 3,872,283 A * 3/1975 Smith et al. ..... 701/207
4,201,908 A * 5/1980 Johnson et al. ..... 377/9
4,493,103 A * 1/1985 Yamashita et al. ..... 382/104
4,549,182 A * 10/1985 Gillet ..... 340/942
4,947,353 A * 8/1990 Quinlan, Jr. ..... 702/158
5,298,738 A * 3/1994 Gebert et al. ..... 250/222.1
5,392,034 A * 2/1995 Kuwagaki ..... 340/933
5,446,291 A * 8/1995 Becker et al. ..... 250/559.24
5,748,108 A * 5/1998 Sampey et al. ..... 340/933
5,752,215 A * 5/1998 Zaaiman et al. ..... 701/117
5,812,249 A * 9/1998 Johnson et al. ..... 356/28
5,942,993 A * 8/1999 Mio et al. ..... 340/933
6,084,533 A * 7/2000 Morgan et al. ..... 340/935
6,188,469 B1 * 2/2001 Liou et al. ..... 100/257

OTHER PUBLICATIONS

JAMAR Technologies, Inc., "TRAX–II TrafficCounter & Classifier—User's Manual", ©1997, all pages.
GK Instruments, "5000 Series", date unknown, all pages.
Peek Traffic, Inc., Internet website printouts, www.peektrafficinc.com printed on Feb. 6, 2001, 12 pages.

* cited by examiner

*Primary Examiner*—Daniel J. Wu
*Assistant Examiner*—Son Tang
(74) *Attorney, Agent, or Firm*—Keith D. Hutchinson; Maymanat S. Afshar

(57) ABSTRACT

The present invention is a vehicle traffic measurement system designed to accurately count and record the number of vehicles passing through a selected location, to more accurately determine and record the velocity at which the individual vehicles travel through that location, and to accurately determine and record in which relative direction the vehicles are traveling as they pass that location. The basic physical principle is of a moving object interrupting two parallel light beams a known reference distance apart, and information extracted from the interruptions sensed and electronically processed into count, direction, and velocity being recorded for subsequent data analysis.

4 Claims, 9 Drawing Sheets

Figure 6

(Cut In Plane Of Wheel Motion)

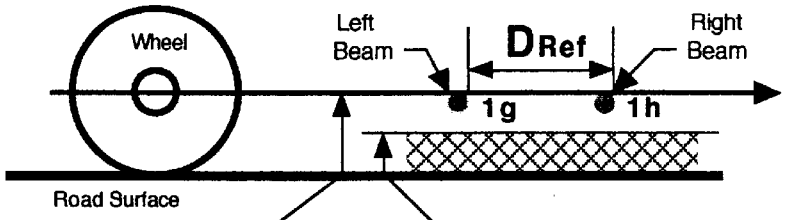

Plane Of Beams Must Be Parallel To Plane Of Road Surface. Height Of Axle (7"-8") Is Preferred Height For Plane Of Beams Above Road Surface Minimum 4" Height Above Road Surface If The Road Surface Is At A Grade, The Plane Of Beams Must Be At The Same Grade And Minimum Of 4" Above Road Surface

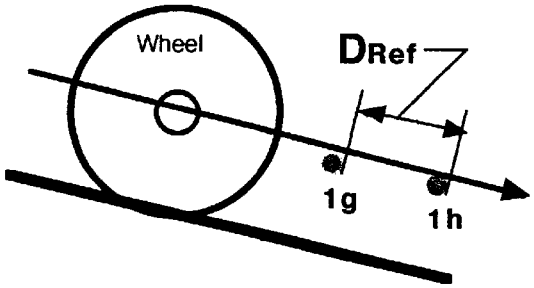

(Cut Perpendicular To Plane Of Light Beams)

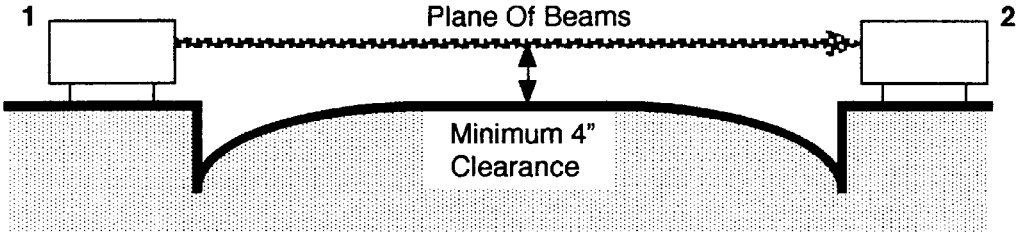

If The Road Surface Has A Crown Curvature, The Plane Of Beams Must Clear The Highest Point Of The Surface Crown By A Minimum Of 4"

OPTRONIC SYSTEM FOR THE MEASUREMENT OF VEHICLE TRAFFIC

CROSS REFERENCE TO RELATED APPLICATIONS

This application claims priority from U.S. Provisional Application No. 60/190,080, filed Mar. 17, 2000, which is incorporated by reference in its entirety.

BACKGROUND OF THE INVENTION

1. Field of the Invention

The present invention relates to the measurement and recording of vehicle traffic and, more specifically, to the count of vehicles moving on a street, measuring the velocity of the vehicles, and determining the relative direction of travel of the vehicles. The present invention is referred to herein as an Optronic System because it integrates an optical light beam emitting and sensor system, sensing light beam interruptions with current state-of-the-art electronics, and digital processing of the vehicle traffic measurements into useful engineering data form. The Optronic System does not sacrifice accuracy for portability, and the system can be moved from one location to another traffic measurement location and set-up quite easily in 15 minutes or less. The Optronic System eliminates the need for embedding inductance type sensors in the pavement of a street, especially at a busy intersection, or taping "hoses" to a street surface.

2. Description of the Related Art

The measurement of vehicle traffic (the number of vehicles passing a location on a street, the direction in which the individual vehicles are traveling, and most importantly the velocity at which individual vehicles are moving on the street) is vital to the traffic engineers and law enforcement personnel of large communities as part of their traffic engineering and public safety responsibilities and activities. Accurate measurements of traffic are necessary at locations where vehicle and pedestrian traffic conditions are hazardous to vehicle operators and/or pedestrians, and the measured vehicle traffic data must be properly analyzed to identify effective solutions for resolving the safety problem or abating the unsafe conditions.

The present traffic measurement system used primarily by traffic engineering personnel is referred to herein as a pneumoelectronic system, since the system is a combination of pneumatic and electronic components and functions to measure the vehicle traffic. The pneumoelectronic system employs one or more pneumatic tubes (often referred to as "hoses") stretched across the street at the location where the measurement of the vehicular traffic is desired to be made. A functional description of the generic type of pneumoelectronic system presently in use is shown schematically in FIG. 1. The schematic in FIG. 1 (and all other Figures included in this document) is not to any dimensional scale, and the size/shape of the hardware units in the system cannot be determined from this functional schematic.

Also at present, vehicle traffic law enforcement personnel use radar equipment for measuring the velocity of moving vehicles, and using the results to control excessive vehicle speeding (as defined in the Motor Vehicle Code) which endangers other vehicles and pedestrians. Radar equipment improvements are constantly being made to improve the accuracy of the measured vehicle velocities, particularly in the moving mode of operation, but the other important aspects of vehicle traffic (counting the number of vehicles and determining their direction of travel at a specific location on a street for traffic engineering use) is not possible with present radar equipment.

The need for an improved traffic measurement system, which can be of more effective use, for example, to both traffic engineering and law enforcement personnel, becomes apparent after considering the limitations and shortcomings of the present traffic measurement systems (pneumoelectronic and radar).

Pneumoelectronic Counting of Vehicles

The measurement of vehicle traffic presently is done with a one- or two-pneumatic tube (each tube sealed at one end) system stretched generally parallel across a street surface in a near-orthogonal orientation to vehicle traffic, as indicated schematically in FIG. 1. The tube system (one or two non-metallic "hoses" of substantial length) is fastened by an installation technician to the street surface, typically with multiple, wide, long strips of an adhesive tape. The unsealed end of the tube(s) are then attached to an electronic box (referred to herein as the data unit), which is typically located in a median strip or on the sidewalk adjacent to the street (or on the shoulder of the street when no sidewalk exists). The data unit is normally not physically located in the traveled portion of the street, as passing vehicles could roll over the data unit and incur crushing damage to the data unit and/or cutting damage to the tires of the vehicle.

The pneumatic tube system is connected through an attachment port on the data unit exterior so as to pass pressure pulses generated in the tube(s) into a pulse sensor (typically an electromechanical pressure transducer) in the data unit. When the front wheels of a vehicle pass over a tube, a pressure pulse is transmitted pneumatically to the pulse sensor which senses the increase in pressure of the pulse. When the pressure pulse is first sensed, the pulse sensor (which functions essentially as a pressure-activated electrical switch) outputs an electrical signal indicating the traffic event (i.e., that a vehicle wheel has passed over and compressed a tube) has taken place. When a count of the number of vehicles passing a selected location on a street is the only traffic parameter of interest to traffic engineering, it is necessary to install only a single detector capable of sensing the passing of the vehicles at that location. Each vehicle wheel passing over a tube compresses the tube and creates a pressure wave traversing through the tube. Two pulses in pressure will be introduced into the single tube by the wheels on the first two axles of a multi-axle vehicle passing over the tube and with a short time interval between the two pulses.

When activated by each pressure pulse, the pulse sensor in the data unit transmits an electronic signal to a multi-function processor, one function being to count the passing of each axle (since all wheels on one axle simultaneously passing over the single tube will result in only one pulse) of each vehicle. Two pulses in rapid sequence are interpreted by the processor as having been generated by the first and second axle of one passing multi-axle vehicle. The sensing logic in the signal processor typically has a "processing pause" after the initial two pulses so as not to count vehicles with more than two axles as being more than one vehicle. The processor then causes a simple counter device to add a unit count into a cumulative count of the number of vehicles passing over the tube(s) in the vehicle traffic volume measurement time period. The cumulative count is typically stored on a recording device also within the data unit, along with the essential date and time of each vehicle passing event to describe the numerical flow of traffic on a time-line basis. These traffic data recordings (referred to herein as line data) are electronically down-loaded from the data unit at the end of the measurement session and printed in hard copy for subsequent analysis by traffic engineering.

The velocity of the passing vehicles is also a traffic parameter of high interest to traffic engineers to study the rate of flow and individual speed of the vehicle traffic passing along a street. When it is desired to both count the number of vehicles passing a location on a street and to also record at what velocity the individual vehicles are traveling, more than one sensor is needed. In order to determine the velocity of vehicles using the pneumoelectronic system, two separated parallel tubes must be installed across the lane(s) of traffic to measure the time interval elapsed by a vehicle passing between the two tubes. As indicated in FIG. 1, the second tube is stretched across the street parallel to and at some pre-selected reference distance, $D_{Ref}$ (typically 8 feet), from the first tube. The second tube is typically fastened to the street surface in the same manner as was done for a single tube (vehicle count only) installation. The second tube also is typically connected to the first tube with a tee connection (at some location where the tee connector will also not be crushed by a passing vehicle) a short distance before the single tube entry port on the same data unit (as previously described to count the number of passing vehicles). In this two-tube arrangement, the passing of each set of the vehicle wheels on an axle over either tube produces a characteristic single pressure pulse (generally of semisinusoidal waveform) transmitted into the pulse sensor within the data unit. After sensing the first two pulse signals in a passing-vehicle traffic event, the processor then "locks out" the remaining pulse signals from the vehicle pulse set (a two-axle vehicle passing over the two tubes will cause four pulses to be transmitted, and a 3-axle vehicle passing over the two tubes will cause six pulses to be transmitted—the number of vehicle axles multiplied by the number of tubes). After approximately one second from the time of "lock out", the system resets itself in preparation for the detection and processing of the next set of pressure pulses generated by the next vehicle passing over the two tubes.

As indicated earlier in this description of the pneumoelectronic system, the pulse sensor serves as an electrical switch and causes an electrical current to pass when the pressure input reaches a pressure level at which the switch has been designed to activate. When the first electrical signal is generated from a pressure pulse event (i.e., when the front wheels of a moving vehicle pass over the first tube) is received (from the pulse sensor) at the processor within the data unit, a timer device is started. When the second electrical signal is generated from the next pressure pulse event (i.e., when the wheels on the first axle of the moving vehicle also pass over the second tube) is received at the processor, the timer device is stopped. The time interval, Δt, between the first and second pressure pulses ($\Delta t = t_{pulse\ 2} - t_{pulse\ 1}$) is measured (to the nearest 0.01 seconds) using the timer device much like a stop-watch at a sport racing event.

The elapsed time it takes for the wheels on the front axle of a vehicle to sequentially pass over each of two tubes (fastened near-orthogonal to the vehicle path vector and parallel to each other) is a function of the vehicle velocity and the distance between the two tubes. Table 1 indicates the length of time (measured in seconds) taken by a vehicle moving at various constant velocities to travel through a reference distance, $D_{Ref}$. Typically in pneumoelectronic system installations, $D_{Ref}$ is selected at 8 feet between the two tubes, because the distance ("wheelbase") between the front and rear axles of small automobiles is generally more than 8 feet (i.e. wheelbases of almost all vehicles are more than 96 inches). This distance of 8 feet assures that the first axle of virtually all motor vehicles will pass over both tubes before the second axle encounters a tube. (Bicycles occasionally passing over the two tubes cannot be discerned by the pneumoelectronic system as not being motor vehicles, and they will be included in the vehicle traffic count made with the tube-type system.)

The equation for calculating the velocity of an object traveling at near constant speed for a known short time duration through a known short distance is found in the Laws of Motion (stated in any standard Laws of Physics reference book as: Velocity (V)=Distance (S)÷Time (t)). Table 1 was constructed using the equation (t=S÷V) to find the time lapsed when the object has a known velocity and passes through a known distance.

TABLE 1

| Vehicle Velocity (mph) | Time To Travel Between 2 Tubes [8 feet apart] (seconds) | Vehicle Velocity (mph) | Time To Travel Between 2 Tubes [8 feet apart] (seconds) |
|---|---|---|---|
| 0 (trivial) | ∞ | 35 | 0.156 |
| 5 | 1.091 | 40 | 0.136 |
| 10 | 0.545 | 45 | 0.121 |
| 15 | 0.364 | 50 | 0.109 |
| 20 | 0.273 | 55 | 0.099 |
| 25 | 0.218 | 60 | 0.091 |
| 30 | 0.182 | 65 | 0.084 |

If the time increment is measured for the time it takes for a vehicle to travel between two tubes a known distance apart, the average velocity of the vehicle can then be calculated using the equation from the Laws of Motion:

$$V(\text{mph}) = k \times D_{Ref}(\text{ft}) \div \Delta t(\text{secs}), \text{ (where } k = 0.6818 \text{ mph per fps).}$$

As can be seen in the equation, the accuracy of the calculated velocity (V) is dependent on the accuracy of the measured lapsed time Δt, as well as on the accuracy of the reference distance $D_{Ref}$. (The conversion factor k is mathematically derived to be accurate to the significant places of the number shown). A timer having an accuracy of Δt=±0.01 seconds is seen to produce a measured and recorded time between two pulses with marginal accuracy at the lower speeds (below 35 mph) primarily of interest to traffic engineers in studying traffic flow. At speeds above about 35 mph, the region of primary interest to law enforcement personnel, a timer having Δt=±0.01 seconds accuracy is not adequate for measuring the time interval Δt for a vehicle moving between two tubes spaced 8 feet apart. For the latter reason, law enforcement personnel almost exclusively rely on radar type equipment to directly measure the speed of the higher speed vehicles with much better (but certainly not extreme) accuracy compared to the velocity indirectly determined with a pneumoelectronic system.

Frequently, one of the shortcomings of the tube-type installation is the adhesive tape being peeled back from the road surface by the traction of a vehicle's wheels passing over the tape, allowing the tube to move significant distances (sometimes as much as 5") laterally. If the objective of the traffic measurement is to obtain only a vehicle count, a loose tube does not affect the accuracy of the vehicle count. This same problem of the adhesive tape losing adhesion and allowing the tube to move laterally is encountered with a two-tube installation. If the objective of the traffic measurement is to obtain the vehicle count and the direction of travel of each measured vehicle, two loose tubes also do not affect either the count of the vehicles or the determination of their direction of travel. However, if the measurement objective is to obtain reasonably accurate vehicle velocity measurements, as well as obtaining the count and direction of travel of the vehicles, a loose tube (one or both in a two-tube installation) is unacceptable for accurate velocity determination.

There are several "ifs" which individually or in combination can severely affect the accuracy of traffic measurements with the pneumoelectronic system. If the vehicle velocity is constant as the vehicle passes over the two tubes, if the two tubes are reasonably parallel across the street and reasonably orthogonal to the passing traffic, if the two tubes fastened to the street surface maintain the pre-selected reference distance $D_{Ref}$ within reasonable accuracy, if the passing vehicle is the only vehicle introducing the first two pulses into the two tubes (a second vehicle passing over the two tubes in the opposite direction at the same approximate time as the first vehicle could contaminate the pulse data sensed), and if the timer measurement of the time interval between the first two sensed pulses was more accurate (i.e., measuring $\Delta t$ to ±0.001 seconds), the two-tubes pneumoelectronic traffic measurement system would provide velocity measurements of sufficient accuracy for traffic engineering purposes. In a field environment, many of these "ifs" are not always achieved, and normally this causes concern over the accuracy of the data. In any case, for law enforcement purposes, an accuracy of ±0.01 seconds for the timer measuring the time between pulses is not acceptable (i.e., a speeding violation could be challenged in a traffic court with near 100% success).

Table 2 indicates the range in calculated velocities for a timer which can measure a time increment $\Delta t$ between pressure pulses to an accuracy of ±0.01 seconds (and with $D_{Ref}$=8 feet):

TABLE 2

| Actual Velocity, mph (100% Accuracy) | Calculated Velocity, mph ($\Delta t$ error = −0.01 sec.) | Calculated Velocity, mph ($\Delta t$ error = +0.01 sec.) |
|---|---|---|
| 25.0 | 26.2 | 23.9 |
| 35.0 | 37.4 | 32.9 |
| 45.0 | 49.1 | 41.6 |
| 55.0 | 61.3 | 50.0 |

If the tubes are installed and maintain a $D_{Ref}$ accuracy of 8 feet (96 inches) ±0.1 inch, there will be no significant reduction in the accuracy of the calculated velocity. However, if the two tubes are not installed at the same $D_{Ref}$ distance as used in the velocity calculation, and/or are not installed with parallelism, and/or one of the tube attachments to the road surface loses adhesion (allowing the loose tube to move apart laterally with respect to the other tube), a change in $D_{Ref}$ distance of 4–5 inches could result in a velocity inaccuracy of ±3 to ±4 mph. As another source of velocity inaccuracy, if both tubes become very loose in a two-tube installation and separate even further than 5 inches, this will generally cause the vehicle velocity to be calculated in an even more inaccurate manner (±5 to ±7 mph). If the two tubes are installed at a $D_{Ref}$ much closer than 8 feet separation distance, the same lateral change (due to looseness) in distance between the two tubes is a greater percentage of the smaller separation distance (reference distance $D_{Ref}$). The inaccuracy of the calculated vehicle velocity if $D_{Ref}$ is 4 feet will be even greater (±10 to ±14 mph). It is also for this accuracy reason that tubes are installed with the largest distance between them (8 feet), but not larger than the wheelbase of the smallest vehicles (which as stated earlier is generally at least 96 inches).

Depending on the combination of the several sources of inaccuracy, vehicle velocity data, especially that at the portion of the traffic velocity spectrum near or above the posted speed limit on the street being measured, potentially has a measured velocity inaccuracy of ±8 to ±10 mph using the two-tube technique. This is clearly not adequate for law enforcement purposes, and also must be considered by traffic engineers in their analysis of the measured vehicle velocity data.

The placement of two tubes physically across a street is recognized to have several other undesirable features, some of which are: (1) affixing the tubes on the street surface is a hazardous operation for the installing technician when the vehicle traffic is not safely detoured around the installation; (2) the tubes are at times dislodged from their attachment to the street surface and lose their reference distance and parallelism calibration; (3) the tubes are damaged too often by passing vehicles (especially by some speeding motorists who maliciously apply heavy braking or skidding as the wheels of their vehicles pass over the tubes); (4) the visual detection of two tubes across the street often causes vehicle operators detecting the tubes from a distance to slow down before passing over the tubes (which "influences" the velocity data measurement); and (5) there are several possible error sources in the pneumoelectronic hardware components and pressure sensing interpretation producing data of questionable accuracy.

Another source of inaccuracy in the measured and calculated velocity of a vehicle occurs when the two tubes are installed across the street such that the $D_{Ref}$ through which the vehicle passes is not the same as the $D_{Ref}$ used in the calculation of the vehicle velocity. Human error is always possible, and the installing technician may set the two tubes at an erroneous $D_{Ref}$ distance apart, or at some angle other than 90° to the travel path of the vehicle. However, this adverse event occurs most often in the installation of a pneumoelectronic type system when the adhesive strips attaching the tubes to the street surface lose their adhesion and allows the tubes to laterally move (increasing or decreasing the $D_{Ref}$) as the wheels of a vehicle pass over the tubes.

The shortcomings of the present pneumoelectronic equipment to accurately and safely measure vehicle direction and velocity, as described heretofore, dictates the need for an improved (i.e., more accurate) means of simultaneously measuring the three primary vehicle traffic parameters, especially vehicle velocity. Because law enforcement personnel require a much more accurate measurement of vehicle velocity than is available with a pneumoelectronic system, radar type equipment is employed by law enforcement personnel to measure the velocity of individual vehicles.

Radar Measurement of Vehicle Velocity

For completeness in describing the techniques presently in use for measuring traffic parameters, the attributes of measuring vehicle velocity with radar equipment is included herein. The acronym RADAR (which has become the noun "radar" in common usage) is derived from its original title RAdio Detection And Ranging. Radar was developed by allied military countries during the early 1940s into a practical means for detecting the presence of an object in the beam path of the radar system, for indicated angle from the zero azimuth angle axis of the radar emitter to the detected object, and for estimating the distance from the radar emitter to the object. Ground-based stationary radar systems were also used to estimate the altitude of aircraft through simple trigonometric calculations performed with the radar estimations of slant distance and angle of inclination from the radar to the aircraft. Radar was not initially developed to be an accurate velocity measuring technique because it used broad-bandwidth radio wavelength radiation which does also sense the motion of secondary objects in the periphery of the primary moving target. Narrow-bandwidth radar equipment with laser pointers to target and measure the velocity of a specific vehicle among a group of moving vehicles is only recently coming into availability to law enforcement personnel for more accurate vehicle velocity measurements.

Radar equipment does have the unique advantage of being able to be operated while in motion (such as in the vehicle of a law enforcement officer) and achieve an acceptable level of accuracy of velocity measurement while accounting for the relative motion between the vehicle-based radar and the target vehicle. Additional corrections are mathematically applied to the moving radar detections to account for the difference in relative velocities between the radar and the target, which must be done to convert the radar information into an absolute velocity of the target vehicle (i.e., miles per hour (mph) relative to the stationary road surface). This introduces further sources of inaccuracies into the measurement and measurement processing. If the indicated velocity (displayed on the operator's dashboard speedometer and input into the radar processor) of the law enforcement vehicle is not accurately calibrated for use in the calculation, an error will be introduced into the relative velocity between the two moving vehicles. This error will manifest itself in the radar equipment displaying an inaccurate velocity for the target vehicle. Currently, only the radar system has this capability of measuring the relative velocity of another moving vehicle while itself is in motion. Existing and emerging fixed-base traffic measurement systems (pneumoelectronic, and embedded inductance loops) cannot practically incorporate any technology that would permit their use in a motion mode.

One disadvantage of the use of radar speed measurement equipment is that it requires a human operator (with attendant personnel costs, but more importantly with the attendant possibility of human error) to operate the radar system in field locations, and to interpret real-time what the indicated velocity displayed means. Law enforcement personnel cannot be present everywhere to assess with radar equipment whether the speed of an individual vehicle is dangerously above the safe speed for the conditions existing at that location on a street (e.g., in a school zone, at a crosswalk, or near a park) or relative to other moving vehicles on that street.

Returning to the description of the present pneumoelectronic traffic measurement system, to determine the direction of travel (i.e., from left to right or from right to left relative to the data unit) of a moving vehicle requires being able to distinguish which of the two pulses in a two-pulse set was created in which tube first. Vehicle direction cannot be determined with a single tube (or any single detector) installation. The two-tubes pneumoelectronic system most frequently merges the input pulses from the individual tubes prior to the pulses entering the data unit, and the pulse sensor interprets these as being two sequential pulses from a single vehicle passing over one tube. The processor function within the data unit is capable of calculating the velocity of the passing vehicle but is unable to discern which pulse was produced in the left or right tube, and therefore is unable to determine the direction of travel of that vehicle.

To obtain more accurate measurements of a vehicle velocity for both traffic engineering and law enforcement purposes than is possible with most present pneumoelectronic traffic measurement systems, to obtain a measurement of the vehicle direction on the street (not always possible with the present pneumoelectronic system), and to avoid the several "real-world" problems being experienced with the present pneumoelectronic system (i.e., tubes having to be fastened on a street surface with vehicles moving by in close proximity to the installing technician and being damaged by traversing vehicles, or their reference separation distance being changed by vehicles passing over them requiring maintenance of the tube installation), an improved and accurate measurement system is needed.

BRIEF SUMMARY OF THE INVENTION

It is, therefore, an object of the present invention, to wit an Optronic System, to provide a vehicle traffic measurement system in which more than one of the disadvantages of the prior art are overcome. In accordance with this objective, there is provided according to the invention a vehicle traffic measuring system comprising a beam emitter unit comprising a first power source and at least two laser beam emitters operatively interconnected to said first power source; a detachable control display subunit comprising a second power source, a beam status discriminator operatively interconnected to said second power source, a pulse oscillator operatively interconnected to said second power source, an electronic chip comprising an electronic timer and clock operatively interconnected to said second power source, a processor operatively interconnected to said second power source, a data recorder operatively interconnected to said second power source, and a display panel operatively interconnected to said second power source; and a sensor control unit comprising at least two laser beam sensors operatively interconnected to said second power source.

There is also provided according to the invention a method of counting individual moving vehicles comprising the steps of generating at least one laser beam from a first unit to a second unit, interrupting said laser beam(s) with a moving vehicle, sensing said interruption(s) of said laser beam(s), processing said sensed interruptions into electronic count data, recording said electronic count data, and formatting and generating a list of said electronic count data into a usable format.

There is also provided according to the invention a method of determining individual vehicle velocity and direction of travel comprising the steps of generating at least two laser beams from a first unit to a second unit, interrupting said laser beams with a moving vehicle, sensing said interruptions of said laser beams, processing said sensed interruptions into electronic velocity and direction of travel data, recording said electronic velocity and direction of travel data, and formatting and generating a list of said electronic velocity and direction of travel data into a usable format.

There is further provided according to the invention a method of counting, determining the velocity and direction of travel of individual vehicles comprising the steps of generating at least two laser beams from a first unit to a second unit, interrupting said laser beams with a moving vehicle, sensing said interruptions of said laser beams, processing said sensed interruptions into electronic count, velocity and direction of travel data, and formatting and generating a list of said electronic count, velocity and direction of travel data into a usable format.

BRIEF DESCRIPTION OF THE DRAWINGS

FIG. 6 schematically indicates the preferred elevation of the installed light beams above the street surface to maximize the accuracy of vehicle velocity measurements collected with the Optronic System.

DETAILED DESCRIPTION OF THE PREFERRED EMBODIMENTS

The invention and its use for measuring vehicle traffic is described hereafter in more detail with reference to the foregoing figures. The Beam Emitter Unit, the Sensor Control Unit, and the detachable Control Display Subunit are the three major components which comprise the Optronic System and are described first in greater detail. The logic used in processing the vehicle traffic measurements into accurate and useful engineering data, and a description of the controls and displays necessary for operating the Optronic System properly and efficiently are also presented. A schematic description of the electrical wiring paths used to interconnect the electronic components of the system and thus enable the processing of the raw field vehicle traffic measurements into accurate and useful data is then described and discussed. Table 3 below presents a summary list of items and their associated reference numbers denoted in FIGS. 2 through 9.

TABLE 3

| Reference Number | Item Description |
|---|---|
| 1 | Beam Emitter Unit |
| 1a | Beam Emitter Unit Assembly Box |
| 1b | Beam Emitter Unit Power Source |
| 1c | Left Beam Emitter |
| 1d | Right Beam Emitter |
| 1e | Left Beam Emitter Orifice Tube |
| 1f | Right Beam Emitter Orifice Tube |
| 1g | Left Light Beam |
| 1h | Right Light Beam |
| 1i | Beam Emitter Unit Center Beam Emitter |
| 1j | Beam Emitter Unit Center Alignment Beam |
| 1k | Beam Emitter Unit Alignment Screwpost |
| 1l | Beam Emitter Unit Center Orifice Tube |
| 2 | Sensor Control Unit |
| 2a | Sensor Control Unit Assembly Box |
| 2b | Left Sensor Control Unit Orifice Tube |
| 2c | Right Sensor Control Unit Orifice Tube |
| 2d | Left Beam Sensor |
| 2e | Right Beam Sensor |
| 2f | Sensor Control Unit Interconnect Cable |
| 2g | Sensor Control Unit Alignment Beam Emitter |
| 2h | Sensor Control Unit Center Alignment Beam |
| 2i | Center Orifice Tube |
| 2j | Alignment Installation Angle Indicator |
| 2k | Sensor Control Unit Alignment Screwpost |
| 2l | Beam L Sensor Status Output Terminal |
| 2m | Beam L Sensor Ground Terminal |
| 2n | Beam L Sensor Power Terminal |
| 2o | Beam R Sensor Power Terminal |
| 2p | Beam R Sensor Ground Terminal |
| 2q | Beam R Sensor Status Output Terminal |
| 3 | Control Display Subunit |
| 3a | Control Display Subunit Assembly Box |
| 3b | Control Display Subunit Input Connector |
| 3c | Control Display Subunit Power Source |
| 3d | Control Display Micro Processor |
| 3e | Beam Status Discriminator |
| 3f | Pulse Oscillator |
| 3g | Timer & Clock Chip |
| 3h | Data Recorder |
| 3i | Control & Display Panel |
| 3j | Control Display Subunit Download Connector |
| 3k | Download Interconnect Cable |
| 3l | Data Transmitter |
| 3m | Data Transmittal RF Wave |

Figure 1:
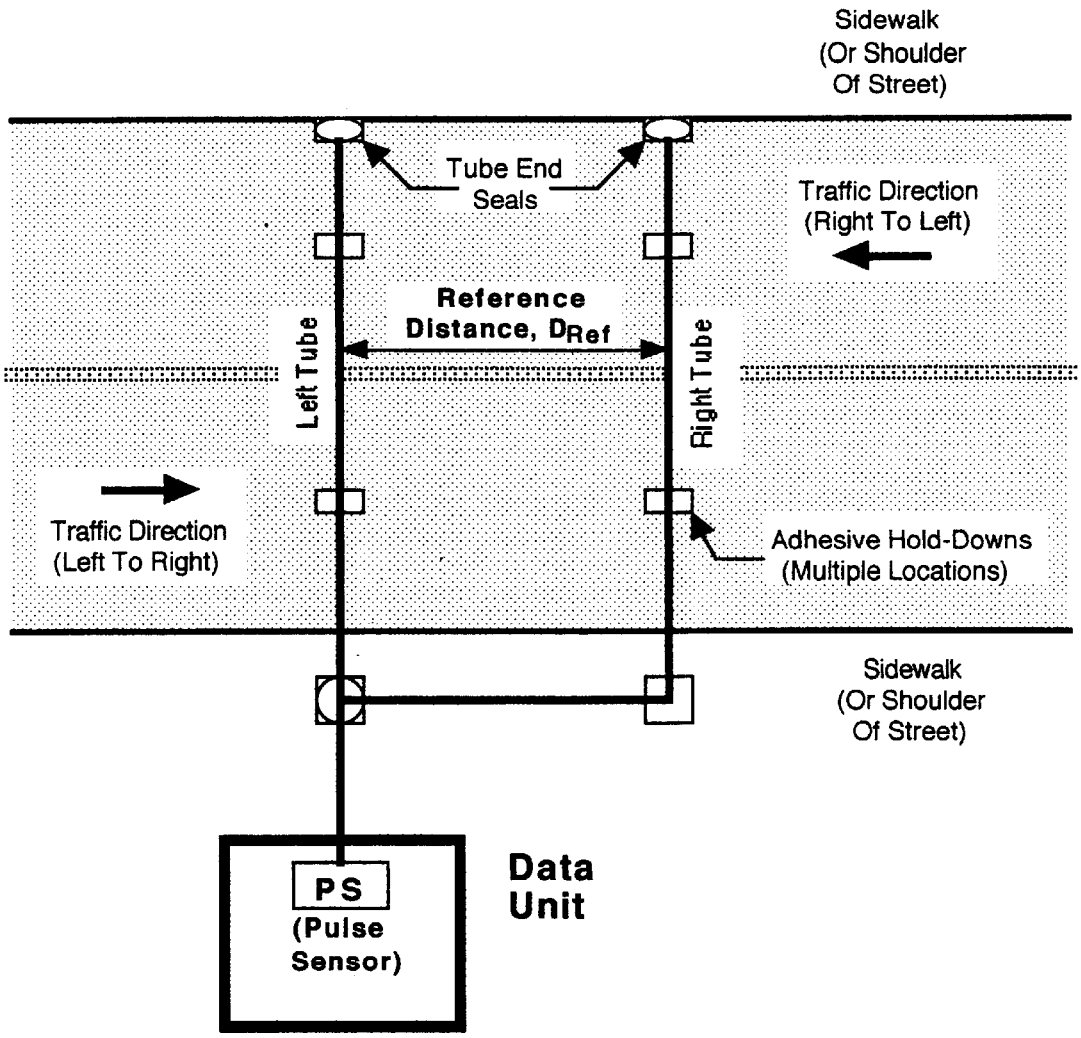
FIG. 1 illustrates a functional schematic of the prior art pneumoelectronic vehicle traffic measurement system presently being used by traffic engineering departments in many large cities.
Figure 2:
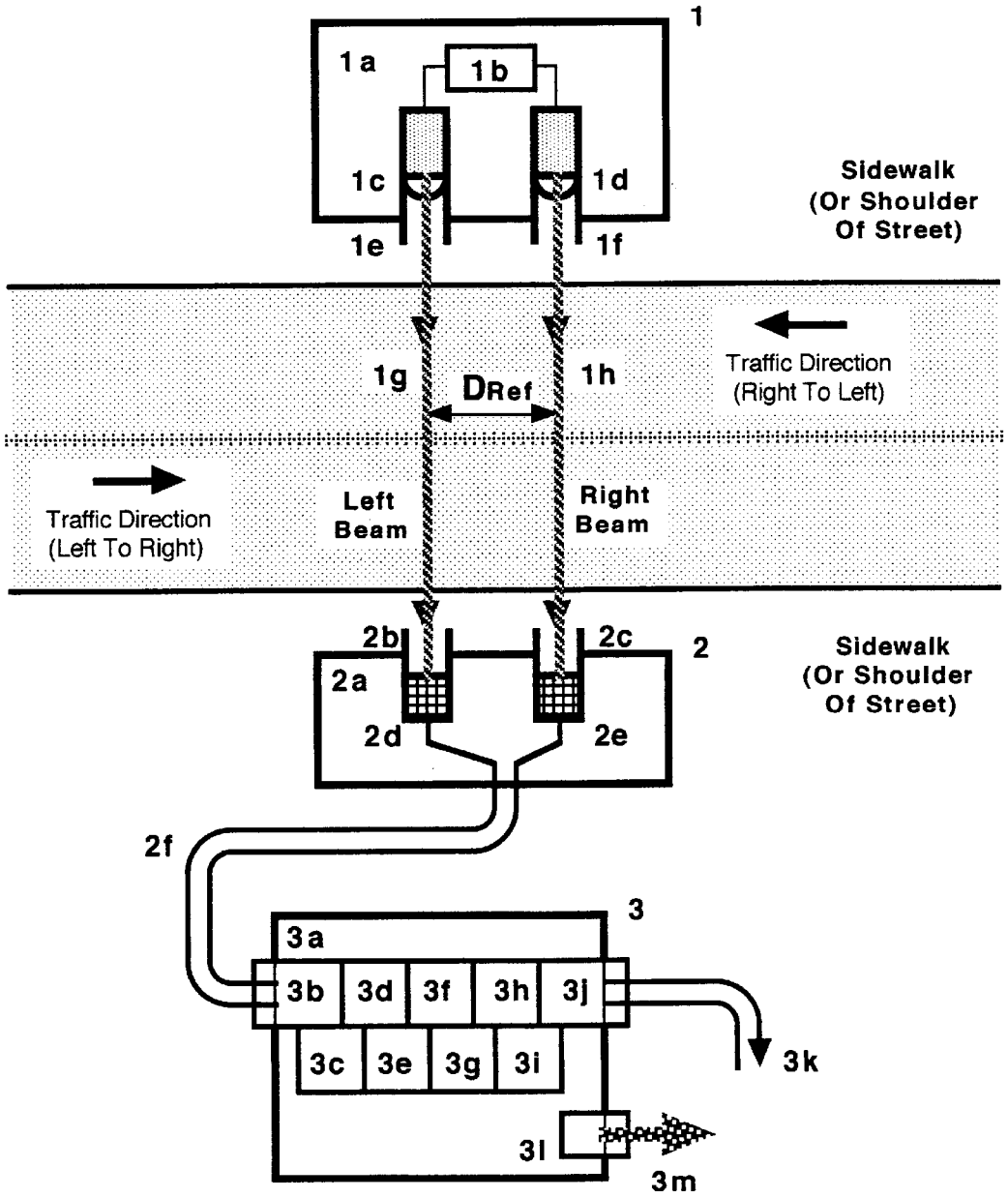
FIG. 2 schematically shows the preferred functional arrangement of the major components of the Optronic System used for measuring the traffic at a street location.

FIG. 2 presents a functional schematic of the preferred installation arrangement of an embodiment of the Optronic System for the measurement of vehicle traffic parameters. The Beam Emitter Unit 1 is installed on one side of a street where traffic is to be measured. The Beam Emitter Unit 1 includes a Beam Emitter Unit Power Source 1*b*, a Left Beam Emitter 1*c* (which produces a Left Light Beam 1*g*), and a Right Beam Emitter 1*d* (which produces a Right Light Beam 1*h*), which are all assembled and operatively interconnected within the Beam Emitter Unit Assembly Box 1*a* and collectively comprise the Beam Emitter Unit 1.

FIG. 2 also shows a Sensor Control Unit 2, which is installed on the opposite side of the street from the Beam Emitter Unit 1. The Sensor Control Unit Assembly Box 2*a* contains a Left Beam Sensor 2*d* and a Right Beam Sensor 2*e* (these two sensors utilize current state-of-the-art photoelectric transistors). The Control Display Subunit 3 in FIG. 2 is detachably interconnected by a Sensor Control Unit Interconnect Cable 2*f* to the Sensor Control Unit 2, in order to facilitate removal of the Control Display Subunit 3 therefrom, and enables the detached Control Display Subunit 3 to be transported to a suitable remote computer facility for extraction of the traffic measurement data processed and recorded therein. The Control Display Subunit Assembly Box 3*a* contains a Control Display Subunit Input Connector 3*b* (female), a Control Display Subunit Power Source 3*c*, a Control Display Micro Processor 3*d*, a Beam Status Discriminator 3*e*, a Pulse Oscillator 3*f*, an electronic Timer & Clock Chip 3*g*, an associated Data Recorder 3*h* (utilizing a current state-of-the-art EEPROM, Electronic Erasable Programmable Read Only Memory), and a Control & Display Panel 3*i*, which are all integrated for the purpose of enabling the Sensor Control Unit 2 and Control Display Subunit 3 to functionally perform as designed. In a preferred embodiment, the Control Display Subunit Power Source 3*c* comprises a typical, off-the-shelf, commercial quality, rechargeable, nickel cadmium cell battery, and such Power Source 3*c* may alternatively comprise a removable battery. In a preferred embodiment, the Control Display Subunit 3 may be permanently mounted at a location (for example, at the drive-in window of a restaurant to count the vehicles and control the velocity of the vehicles patronizing the establishment). In this second preferred embodiment, the Control Display Subunit Power Source 3*c* is hard-wired from within the location instead of being a rechargeable type battery. Inasmuch as all of the electrical components of the Sensor Control Unit 2 and the Control Display Subunit 3 are designed to operate with 6V DC source current, a transformer rectifier is also installed (in this second preferred embodiment) in the Control Display Subunit 3 to convert the hard-wire source 120V AC current entering the Control Display Subunit Power Source 3*c* electrical circuit into 6V DC current so as not to damage (by over-voltage) any of the electrical components of the Sensor Control Unit 2 and the Control Display Subunit 3. A Control & Display Panel 3*i* under the top cover of the detachable Control Display Subunit 3 of the Optronic System permits the installing technician to define the installation details unique to each system installation and therewith to maximize the accuracy of the vehicle traffic measurements to be made. The Control Display Subunit 3 also contains a Control Display Subunit Download Connector 3*j* (female, DB9), an accessory Download Interconnect Cable 3*k* (male/female DB9, compatible with the DB9 pin-out configuration on the serial port of PC/IBM compatible computer equipment), and an optional Data Transmitter 3*l*, which optionally transmits selected data from the Data Recorder 3*h* on the Data Transmittal RF Wave 3*m* to a remote location.

Figure 3:
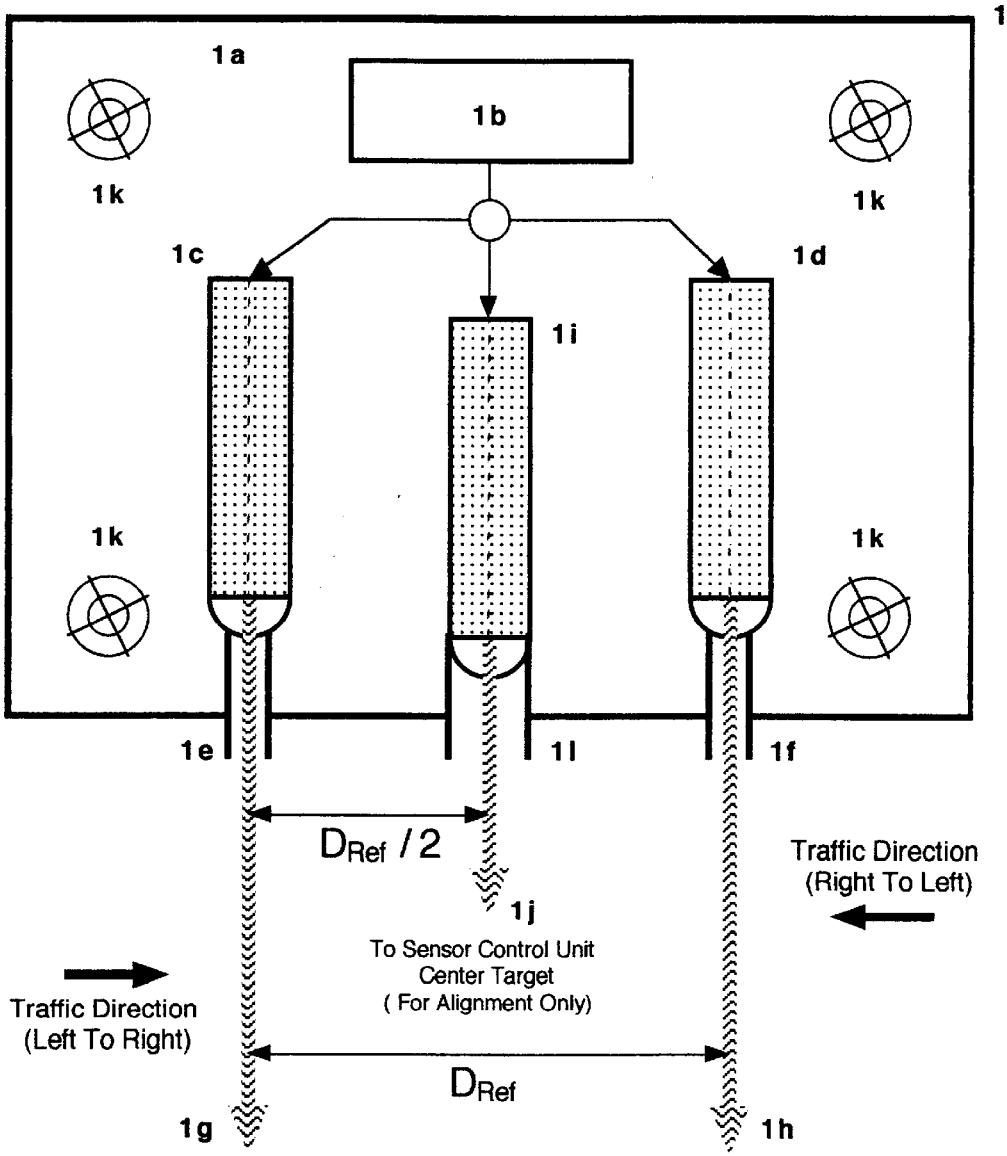
FIG. 3 illustrates the preferred components comprising the Beam Emitter Unit of the Optronic System, and briefly indicates the functional relationship of the components to the overall performance of the Optronic System.

FIG. 3 presents a slightly more detailed internal arrangement of preferred subcomponents within the Beam Emitter Unit 1 than was shown in FIG. 2. Standard electronic hardware subcomponents of current, commercially available, state-of-the-art electronic technology are used as Beam Emitters (designated as the Left Beam Emitter 1*c*, the Right Beam Emitter 1*d*, and the Center Beam Emitter 1*i*, which is used only for system installation alignment purposes) to generate the respective low-power visible wavelength laser Light Beams 1*g*, 1*h* and 1*j*. Low-power lasers avoid the safety problems to humans and animals associated with higher power lasers. It should also be noted that visible wavelength laser beams are not truly visible to the unaided human eye, and become visible only when striking a particle having mass in its path. The Beam Emitter Unit Assembly Box 1*a* contains a Beam Emitter Unit Power Source 1*b* to power the three laser Beam Emitters (1*c*, 1*d*, and 1*i*). In a preferred embodiment, the Beam Emitter Unit Power Source 1*b* is a typical off-the-shelf, commercial quality, rechargeable, nickel cadmium cell battery, but a hard-wired Power Source 1*b* may alternatively be used in the invention. In a preferred embodiment, the Beam Emitter Unit 1 may be permanently mounted at a location (for example, at the drive-in window of a restaurant to count the vehicles and control the velocity of the vehicles patronizing the establishment). In this preferred embodiment, the Beam Emitter Unit Power Source 1*b* is hard-wired from within the location instead of being a rechargeable type battery. Inasmuch as the three BeamEmitters 1*c*, 1*d*, and 1*i* are designed to operate with 6V DC source current, a transformer rectifier is also installed (in this preferred embodiment) in the Beam Emitter Unit 1 to convert the hard-wire source 120V AC current entering the Beam Emitter Unit Power Source 1*b* electrical circuit into 6V DC current so as not to damage (by over-voltage) the three Beam Emitters 1*c*, 1*d*, and 1*i*. The Beam Emitter Unit Left and Right Beam Emitters 1*c* and 1*d* are mounted in the Beam Emitter Unit Assembly Box 1*a* at the time of manufacture to be precisely coplanar and parallel at a known reference distance (DREF) of, for example, 1 foot apart.

The Left and Right Light Beams 1*g* and 1*h* generated within the Beam Emitter Unit 1 exit the corresponding Beam Emitters 1*c* and 1*d* through the respective Beam Emitter Unit Orifice Tubes 1*e* and 1*f*, and propagate across the street towards the Sensor Control Unit 2. The two Left and Right Light Beams 1*g* and 1*h* are generally orthogonal to passing vehicle traffic. A manual switch (not shown) atop each of the three Beam Emitter Unit Beam Emitters (Left 1*c*, Right 1*d*, and Center 1*i*) will allow the installing technician to activate the Beam Emitter Unit Center Beam Emitter 1*i* when performing the alignment mode of the Optronic System installation, as well as to activate the two primary Beam Emitter Unit Beam Emitters 1*c* and 1*d* in the subsequent vehicle traffic measurement mode of operation. (If the measurement only of vehicle traffic count is planned, only the Left Beam Emitter 1*c* will be activated ON. The Right Beam Emitter 1*d* need not be activated in order to minimize the Beam Emitter Unit Power Source 1*b* energy consumption for a potentially lengthy traffic measurement session).

Figure 4:
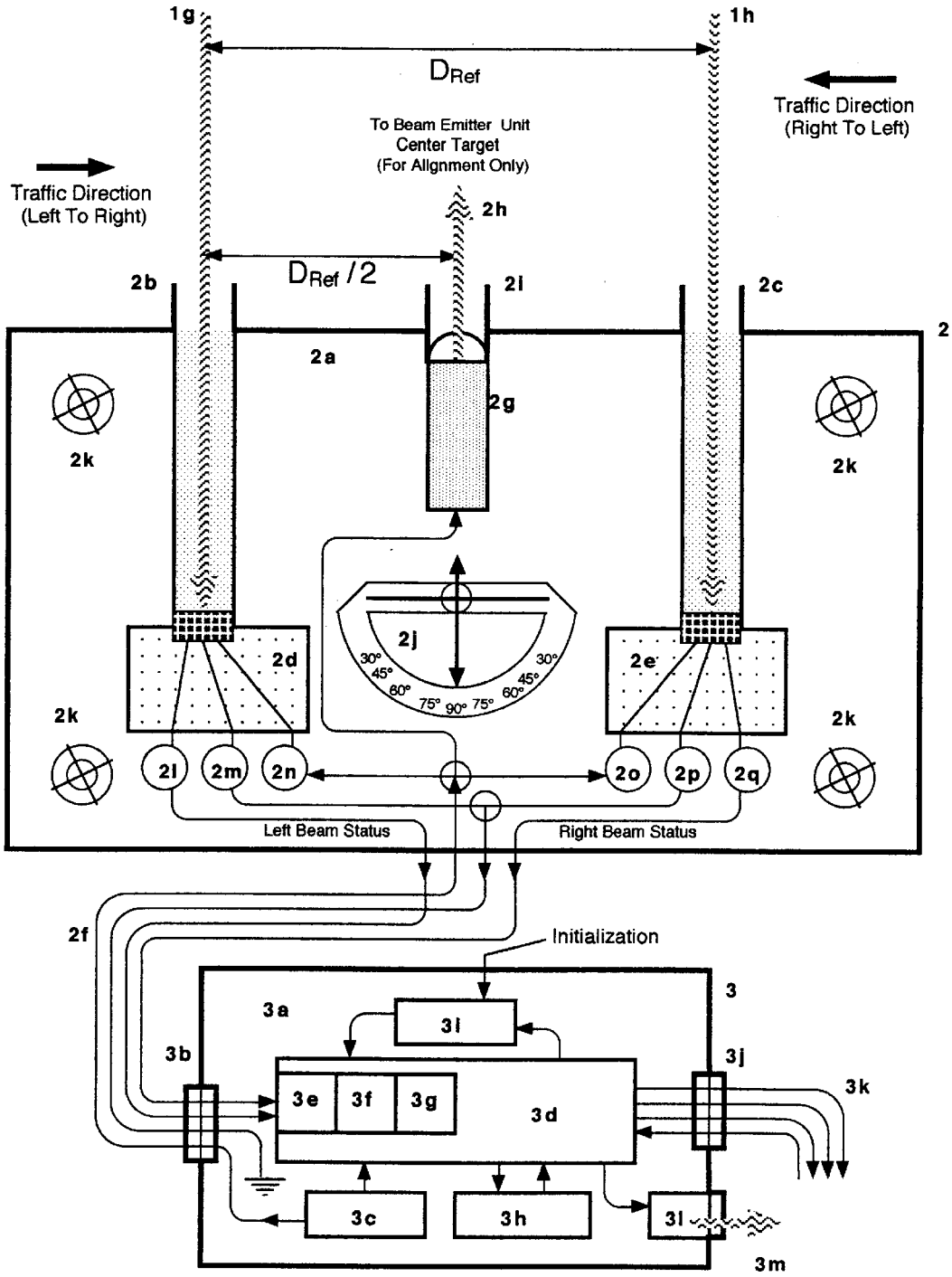
FIG. 4 illustrates the preferred Control Display Subunit and components comprising the Sensor Control Unit of the Optronic System, and briefly indicates the functional relationship of the components to the overall performance of the Optronic System.

Careful alignment of the Beam Emitter Unit 1 and the Sensor Control Unit 2, shown schematically in FIG. 4, is crucial to the obtaining of the traffic measurement data. In its preferred configuration, the Optronic System has four laser beam emitters—three on the Beam Emitter Unit 1, and one on the Sensor Control Unit 2. The reason for the alignment being crucial is that if the two primary emitted laser beams (Left Light Beam 1*g* and Right Light Beam 1*h*) from the Beam Emitter Unit 1 do not impinge on the photoelectric transistors within the two Beam Sensors 2*d* and 2*e*, the laser beams will not provide the laser beam ON or OFF signals associated with passing vehicles interrupting the beams and the traffic measurements will not be properly collected. The two Center Alignment Beam Emitters 1*i* and 2*g*, positioned very accurately on the center line of the Beam Emitter Unit 1 and the Sensor Control Unit 2, respectively, have been added to facilitate the alignment of the two primary laser beams passing between the Beam Emitter Unit 1 and Sensor Control Unit 2. During the alignment procedure, all four Beam Emitters (1*c*, 1*d*, 1*i*, and 2*g*) when activated ON will emanate the four beams which will all be coplanar and which will all be mutually parallel. The two center alignment beams 1*j* and 2*h* are precisely half-way between (i.e., everywhere equidistant from) the outer two primary beams 1*g* and 1*h* which are $D_{Ref}$ distance apart. It is helpful in understanding the crucial alignment requirement if one envisions a large rectangle on the plane of the beams extending across the street and between the Beam Emitter Unit 1 and the Sensor Control Unit 2. The two corners of the rectangle at the Beam Emitter Unit 1 are the Beam Emitters 1*c* and 1*d*, and the two corners at the Sensor Control Unit 2 are the Beam Sensor Units 2*d* and 2*e*. Bisecting this rectangle longitudinally are the two center alignment beams 1*j* and 2*h*, which if both were activated ON at the same time would be coincident with each other. The two center alignment beams 1*j* and 2*h* also form the axis of rotation of the large alignment rectangle, and it is about this axis of rotation that the two major units (the Beam Emitter Unit 1 and the Sensor Control Unit 2) are rotated using the Alignment Screwposts (located at the four corners of the two major units) to bring the four corners of the alignment rectangle into the same plane. The alignment procedure for the Optronic System is analogous to that of turning the adjusting screwfeet at the four bottom corners of a residential refrigerator, range, or washing machine to bring it into level.

The six orifice tubes (three on the Beam Emitter Unit 1 and three on the Sensor Control Unit 2) perform four important functions: (1) to extend a distance from the face of the Unit assembly box and minimize the entry of splashed water or foreign objects from being thrown by passing vehicles into the interior of the Unit and adversely affecting the functional performance of the component at the interior end of the orifice tube into the Unit; (2) to serve as a visual guide in pointing the two Units so that they directly face each other in preparation for the finer alignment using the emitted laser beams; (3) to provide a means for capping the orifices when those orifices are not in use; and (4) to hold the four larger diameter, loose-fitting, screw-on caps which have laser target cross-hairs (imprinted with a reflecting paint) on their face directly over the center of the orifices. Four of the Orifice Tubes (1*l* and 2*b*, 2*c*, and 2*i*) are of circular cross-section approximately ⅝" in diameter, and extend approximately ½" away from the exterior face of the Unit assembly box. Orifice Tubes 1*e* and 1*f* are of smaller diameter (⅜"), and the caps for these two Orifice Tubes 1*e* and 1*f* do not require any target imprint on their face.

The six caps should be in place (on the ends of the six orifice tubes) whenever the two Units 1 and 2 are in storage awaiting use in a street traffic measurement and/or when transporting the Units to a measurement location. During the alignment process, the sequence of removing and replacing the caps (after the two Units 1 and 2 are placed on opposing sides of the street and have been visually pointed to face each other—in coarse alignment) is recommended to be: (1) Remove (and place aside for later use) the cap on the center Orifice Tube 2*i* on the Sensor Control Unit 2, and activate the center Alignment Beam Emitter 2*g* on the Sensor Control Unit 2. The center Alignment Beam 2*h* should impinge somewhere close to the target imprinted on the opposing cap on the center Orifice Tube 1*l* on the Beam Emitter Unit 1. The four Alignment Screwposts 2*k* should then be adjusted to bring the center Alignment Beam 2*h* to impinge on the intersection of the cross-hairs on the center target of Orifice Tube 1*l* on the Beam Emitter Unit 1. Once in alignment, the center cap (with a target imprinted on it) should be replaced on the center Orifice Tube 2*i*, and the center Beam Emitter 2*g* switched OFF; (2) Proceed to the Beam Emitter Unit 1, remove all three caps on the three Orifice Tubes 1*e*, 1*f*, and 1*l*, and switch ON all three Beam Emitters 1*c*, 1*d*, and 1*i*. The alignment elevation and angle of the Beam Emitter Unit 1 should be adjusted (using the four Alignment Screwposts 1*k* on the four corners of the Beam Emitter Unit 1) until all three emitted Beams 1*g*, 1*h*, and 1*j* impinge on the respective three target caps on the Orifice Tubes 2*b*, 2*c*, and 2*i* on the Sensor Control Unit 2. When aligned accurately, the center Beam Emitter 1*i* is then switched OFF, and the cap (with target) replaced on the end of center Orifice Tube 1*l*; (3) Return to the Sensor Control Unit 2, closely observe the targets on the two caps on the two Orifice Tubes 2*b* and 2*c* to assure that the two active Beams 1*g* and 1*h* from the Beam Emitter Unit 1 are impinging at the target cross-hairs on both target caps on Orifice Tubes 2*b* and 2*c*. The two target caps may then be removed, using care not to disrupt the alignment of the Sensor Control Unit 2, from the Orifice Tubes 2*b* and 2*c*, and the Beams 1*g* and 1*h* should then be impinging on the face of the photoelectric transistors at the interior end of Orifice Tube 2*b* and 2*c*; (4) The remainder of the installation and initialization of the Optronic System is done with the Control Display Subunit 3 attached on the long cable 2*f*, and the traffic measurement session conducted. At the completion of the traffic measurement session, the two Beam Emitter Units 1*e* and 1*f* are switched OFF and the four caps are replaced on the ends of the four Orifice Tubes 1*e*, 1*f*, 2*b*, and 2*c*.

When the Optronic System is in the alignment and traffic measurement modes, the status (ON or OFF) of the two Light Beams 1*g* and 1*h* entering through the two Sensor Control Unit Orifice Tubes 2*b* and 2*c* are sensed (ON or OFF) by photoelectric transistors within the respective Sensor Control Unit Beam Sensors 2*d* and 2*e*, and are converted (by the photoelectric transistors) into electrical signals for discrimination processing (non-interrupted ON and interrupted OFF status) by a Beam Status Discriminator 3*e* in the Control Display Subunit 3. The Beam Sensors 2*d* and 2*e* perform the light beam sensing function as "electric eyes" (which are more technically correct to be referred to as photoelectric transistors). The economic and proven technology of photoelectric transistors (such as in the Left Beam Sensor 2*d* and the Right Beam Sensor 2*e*) is found commonly in residential uses (e.g., to cause an automatic closing garage door to reverse its closing motion if the beam of light across the door opening is interrupted by an object, person, or animal). Photoelectric transistors are still more widely used in many commercial applications in controlling and safety-proofing the operation of manufacturing machinery.

The Beam Status Discriminator 3*e* serves as a sub-Processor at the interface between the two Beam Sensors 2*d* and 2*e*, and the Control Display Micro Processor 3*d*. The Beam Status Discriminator 3*e* discerns which of the two Light Beams 1*g* and 1*h* entering the Sensor Control Unit 2 was interrupted first, and therefore identifies whether the vehicle was traveling from left to right or right to left relative to the Light Beams 1*g* and 1*h* entering the face of the Sensor Control Unit 2.

Whenever the left Light Beam 1*g* is interrupted OFF, the Control Display Micro Processor 3*d* adds a unit count to the cumulative total counter of the vehicle traffic being measured. So as not to count each axle on a passing multi-axle vehicle as one vehicle, the programmed logic in the Control Display Micro Processor 3*d* does not count any further interruptions of the Left Light Beam 1*g* for one second after the first axle is counted—thus allowing ample time for multi-axle vehicles to pass through the measurement system and be counted properly as only one vehicle.

Secondly, the beam interruption signals received by the Beam Status Discriminator 3*e* are converted most simply in determining in which direction the measured vehicle is traveling at the time of the measurement. Using the simple comparison logic that if the left beam is interrupted before the right beam, the vehicle is traveling from left to right. Conversely, if the right beam is interrupted before the left beam is interrupted, the vehicle must be traveling from right to left.

The output signals (beam interruption signals) from the Beam Status Discriminator 3*e* are used most importantly in determining the velocity of the vehicle passing through the measurement system. To accomplish this portion of the vehicle traffic data measurement, the output signal from the Beam Status Discriminator 3*e* when either one of the Light Beams 1*g* or 1*h* is interrupted causes a Timer & Clock Chip 3*g* to electrically excite a Pulse Oscillator 3*f* co-resident with the Control Display Micro Processor 3*d* to start oscillating. The preferred Pulse Oscillator 3*f* pulses at the rate of 625 pulses per millisecond and has an accuracy of ±3 pulses independent of the length of pulse oscillation time. One example of a preferred Pulse Oscillator 3*f* used in the Optronic System is a PIC16F877 Microcontroller, manufactured by Microchip Technology, Inc. When the second Light Beam (either 1*g* or 1*h*) is discerned by the Beam Status Discriminator 3*e* to have been interrupted by a passing vehicle, the signal is relayed instantaneously to the Timer & Clock Chip 3*g*, which in turn removes the electrical excitation from the Pulse Oscillator 3*f*, causing it to stop oscillating. One example of a preferred Timer & Clock Chip 3*g* used in the Optronic System is a DS1302 Trickle Charge Timekeeping Chip, manufactured by Dallas Semiconductor Corporation. The Timer portion of the Timer & Clock Chip 3*g* determines the total number of pulse oscillations which the Pulse Oscillator 3*f* has performed during the time interval Δt it was oscillating and converts that total number of pulses into the number of milliseconds lapsed by dividing the total number of pulses by 625 pulses per millisecond (the characteristic oscillating frequency for the Pulse Oscillator 3*f*). This timing technique provides a highly accurate time interval Δt in milliseconds. The Control Display Micro Processor 3*d* then processes the measured time interval Δt milliseconds and the known $D_{Ref}$ (1 foot) into an accurate vehicle velocity using the mathematical equation from the Laws of Motion described in Table 2 earlier in this document.

With the count of the vehicles (C), the direction of travel of the vehicles (D), and the velocity of the vehicles (V) determined, the Control Display Micro Processor 3*d* sends that collective information ("CDV data"), and the other variable data (e.g., time of day) to the Data Recorder 3*h* in a Line Data format. The Data Recorder 3*h* is a commercially available, state-of-the-art EEPROM type device used extensively in electronic devices world-wide.

At the end of a vehicle traffic measurement recording session, the Control Display Subunit 3 is detached (at Connector 3*b*) from the Sensor Control Unit 2 and taken to a computer facility where the Line Data resident in the Data Recorder 3*h* is downloaded through the serial port of a computer into the computer for analysis, print-out in a well-documented and useful form, and for further use by traffic engineers and/or law enforcement personnel.

Radiating laser light beams (such as Light Beams 1*g* and 1*h*) of any power level in a populated area obviously has environmental safety considerations where humans and/or animals may be exposed to the lasers. Low power (i.e., having an electromagnetic energy level not capable of causing the ignition of any flammable material and not capable of causing physical damage to external skin of humans or animals) visible wavelength lasers used in widespread public use (in commercial and residential applications, as well as by surveyors in mapping, and by construction personnel in aligning structural components or excavations) are installed with appropriate safety cautions clearly marked thereon. A warning plate on the top of each of the Beam Emitter Unit 1 and Sensor Control Unit 2 on the sidewalk or shoulder of the street cautions pedestrian passers-by not to stare into the low power laser Light Beams 1*g* and 1*h* crossing the street (which, although being of visible wavelength, they are invisible to the unaided human eye) or into the Emitter Orifice Tubes 1*e*, 1*f* and 1*l*. Since the laser Light Beams 1*g* and 1*h* are typically positioned less than 10 inches above the street surface, a person would have to place his/her head on the street surface to stare into the Beam Emitter Unit 1. Further, the laser Light Beams 1*g* and 1*h* are confined to the region between the faces of the two main components (Beam Emitter Unit 1 and Sensor Control Unit 2) of the Optronic System. The Light Beams 1*g* and 1*h* are not likely to be propagated significantly elsewhere than in that short, confined corridor between the Beam Emitter Unit 1 and the Sensor Control Unit 2, barring tampering or vandalism causing the Beam Emitter Unit 1 to radiate the laser beams along spurious paths.

The placement and careful alignment of the Beam Emitter Unit 1 and the Sensor Control Unit 2 of the Optronic System during installation at a desired street location has been shown to be crucial to obtaining accurate vehicle velocity measurements at that location. As shown in FIG. 2, installers and monitors of the Optronic System do not have to perform any installation or beam monitoring activity in the vehicle-traveled portion of the street, thus avoiding the hazardous exposure of the installers of the Optronic System to passing vehicles.

Figure 5:
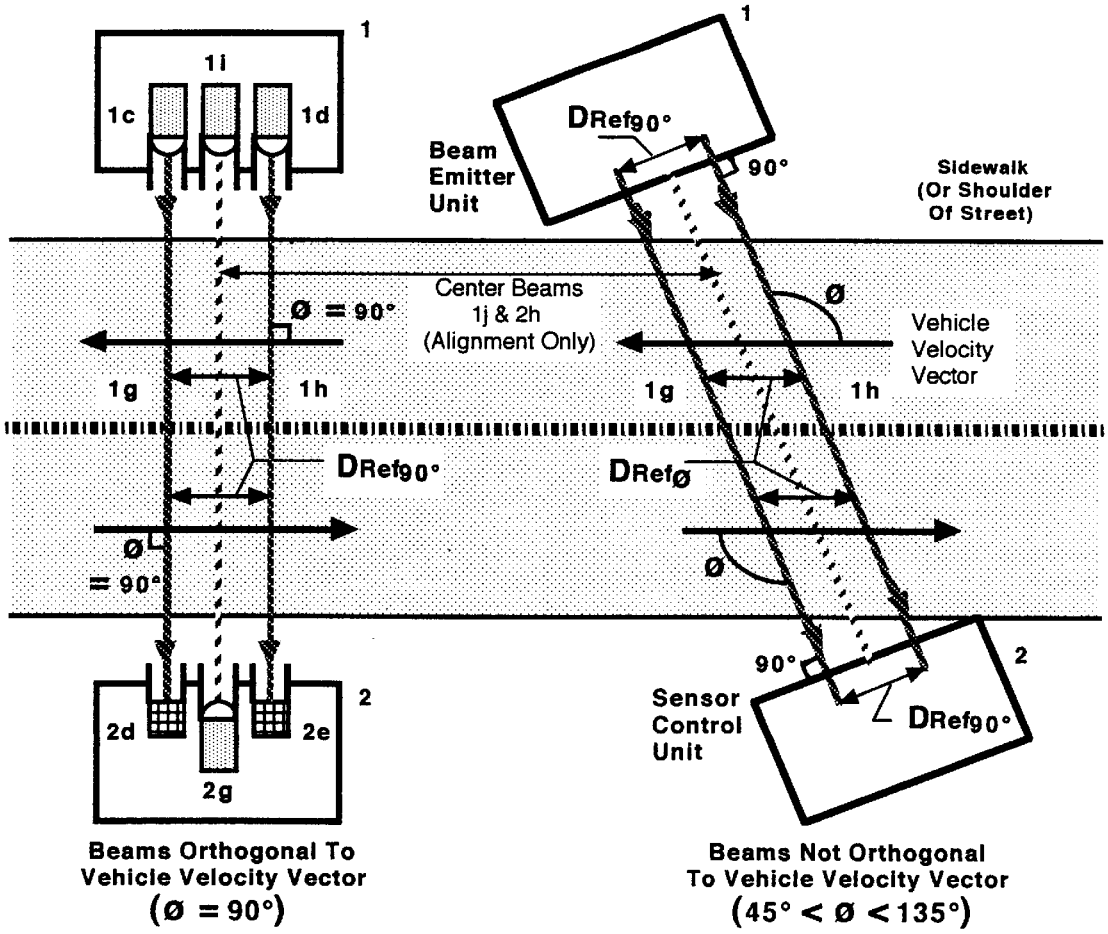
FIG. 5 schematically presents the geometric reason dictating that a trigonometric correction factor be applied to the reference distance actually traversed by vehicles passing through the Optronic System when the system cannot be installed orthogonal to the vehicle traffic vector. This correction is required in order to maximize the accuracy of vehicle velocity measurements processed within the Optronic System.

FIG. 5 shows a preferred installation of the Sensor Control Unit 2 installed in the preferred orthogonal orientation to the passing traffic. The two Light Beams 1*g* and 1*h* emitted from the Beam Emitter Unit 1 propagate above the surface of the street in parallelism and are co-planar everywhere including at the face of the Sensor Control Unit 2. The reference distance through which vehicle traffic passes between the parallel Light Beams 1*g* and 1*h* is referred to herein as $D_{Ref}$. This $D_{Ref}$ is selected as nominally 1 foot partly for ease of mathematical calculations. More importantly, a $D_{Ref}$ of 1 foot is also less than the diameter of a vehicle wheel (usually 14 or 15 inches in diameter), such that both Light Beams 1*g* and 1*h* will be simultaneously interrupted as a vehicle wheel passes through the light beams.

When possible, the two Light Beams 1*g* and 1*h* are installed orthogonal (90°) to the vehicle path vector as it moves though the two beams in the measurement system. (The two parallel Light Beams 1*g* and 1*h* across the street are interrupted, but cannot be damaged, by passing vehicles traveling in either direction). For those uncommon occurrences when the two Light Beams 1*g* and 1*h* physically cannot be installed orthogonal to the vehicle traffic vector (i.e., they must be installed at a diagonal angle across the street), the $D_{Ref}$ must be adjusted before use in the vehicle velocity computation because of the geometric lengthening of the actual $D_{Ref}$. To account for an installation of the Optronic System requiring a non-orthogonal angle $\theta$ (ranging anywhere from 45° to 135°) relative to the vehicle path vector, a trigonometric correction to the actual $D_{Ref}$ used in the vehicle velocity computation has been derived as: $D_{Ref}\theta = D_{Ref}90°/\cos(90°-\theta)$. The non-orthogonal angle $\theta$ (in degrees) is obtained during the Optronic System installation and alignment process using a protractor-type device Alignment Angle Indicator 2*j* affixed on the upper surface of the Sensor Control Unit 2, as shown in FIG. 4. The angle $\theta$ is estimated with the aid of the Alignment Angle Indicator 2*j*, and is input directly into the Control Display Subunit 3 through the Control & Display Panel 3*i* (to be described later in more detail with FIG. 8). For most installations, the angle $\theta$ will be within a few degrees of 90° (orthogonal) and the cosine correction factor will be unity for accuracy purposes.

Accordingly, a default alignment angle of 90° for $\phi$ is programmed into the Control Display Processor 3*d*, and unless changed by a direct input for the alignment angle $\phi$ other than 90° a correction to $D_{Ref}$ is unnecessary.

FIG. 6 shows the geometric basis for the installation requirement on beam elevation distance above the street surface. The large rectangular pattern (formed by the two co-planar and parallel laser Light Beams 1*g* and 1*h* and with the two major system components Beam Emitter Unit 1 and Sensor Control Unit 2 at each end of the rectangle) is not required to be perfectly horizontal, but should be as parallel to the plane of the road surface as the terrain permits under practical street conditions. If the road surface is at a grade, the plane of the beams must be at the same grade. It is relatively important that the height of the two parallel Light Beams 1*g* and 1*h* are equidistant above the street surface so that whatever physical feature of the passing vehicle (e.g., the front bumper, a front fender, the leading edge of a wheel, the manufacturer's hood ornament, the bolt head on the front license plate holder, etc.) interrupts the first beam will be the same physical feature of the passing vehicle which interrupts the second beam. The height of a vehicle axle (typically about seven to eight inches above the road surface) is the preferred height for the plane of the Light Beams 1*g* and 1*h* above the road surface. A typical minimum height for the plane of Light Beams 1*g* and 1*h* above the road surface is about four inches. If the road surface between the placement of the Beam Emitter Unit 1 and the Sensor Control Unit 2 has a crown curvature, then the plane of Light Beams 1*g* and 1*h* preferably clears the surface curvature "crown" by a minimum of about four inches.

Because the Light Beams 1*g* and 1*h* are not visible to vehicle operators (without having eye optical aids) approaching the Optronic System installed at the sides of a street, the vehicle operators will pass through the measuring location without prior knowledge of their motion being detected and recorded. This will produce much more "uninfluenced" traffic measurement data for traffic engineering and law enforcement purposes than when traffic measurement equipment (such as 1 inch diameter "hoses" across a street surface or a law enforcement marked vehicle) is visible to vehicle operators.

The diameter of the Light Beams 1*g* and 1*h* is larger than the diameter of a large raindrop so that operating the Optronic System in rainy weather or heavy fog conditions will not result in beam interruptions (i.e., resulting in raindrops being counted and recorded as passing vehicles). A large diameter beam also allows better tolerance of the system to small installation misalignments of the path of the beam from the Beam Emitter Unit 1 through a relatively small orifice (approximately ½" diameter) on the Sensor Control Unit 2 many yards away and onto the small circular (approximately ¼" diameter) sensing area on the face of the photoelectric transistor in each Beam Sensor 2*d* and 2*e*.

To keep each component secure to the surface of the sidewalk, a long, wide strip of adhesive tape (or other bonding adhesive material) may be attached over the foot of each Alignment Screwpost of the component and fastened down to the surface. For installations on the roadside which may not be of concrete or some other form of firm pavement, there are holes in the bottom pad of each Alignment Screwpost 1*k* and 2*k* (a total of 8 per installed system) through which small stakes may be driven into the ground to anchor the component. The components may be placed free-standing on a sidewalk or street shoulder surface, but are at risk of being vibrated out of alignment by heavy vehicles such as trucks passing along the street. Free-standing components are also at risk of being tampered with or stolen unless securely attached to the concrete or ground, and/or chained to a pole or tree.

It is foreseen that the Light Beams 1*g* and 1*h* may be interrupted also by a pedestrian (walking, jogging, or bicycling) or, more infrequently, by a stray animal, a bird, or a large flying insect passing through the beams. The Optronic System counts each interruption of the left Light Beam 1*g* as a passing vehicle, regardless of the nature of the body interrupting the beam. The Optronic System also calculates a velocity (V) for, and determines a direction (D) of the interrupting body if both Light Beams 1*g* and 1*h* are interrupted. The recorded count, direction of travel, and velocity data (CDV data) should be visually scanned on a line-by-line basis by the data analyst (or by the computer itself) at the end of the traffic measurement recording session, and those line records indicating a velocity below five mph should be disregarded in the count (i.e., subtracting the number of apparently non-vehicle-caused interruptions from the vehicle total count C). If the street to be measured has a large amount of pedestrian travel on the adjacent sidewalks, the two components of the Optronic System should be placed as near to the curb on the sidewalk next to the street as is possible to reduce the number of pedestrians interrupting the beams. If the beams are traversed and interrupted by a walking pedestrian, the walking pace of a human is generally less than 5 mph and the velocity calculated (less than five mph) should again cause the traffic data analyst to regard the line of data as being non-vehicle caused and to subtract that line of data from the total vehicle count C.

Figure 7:
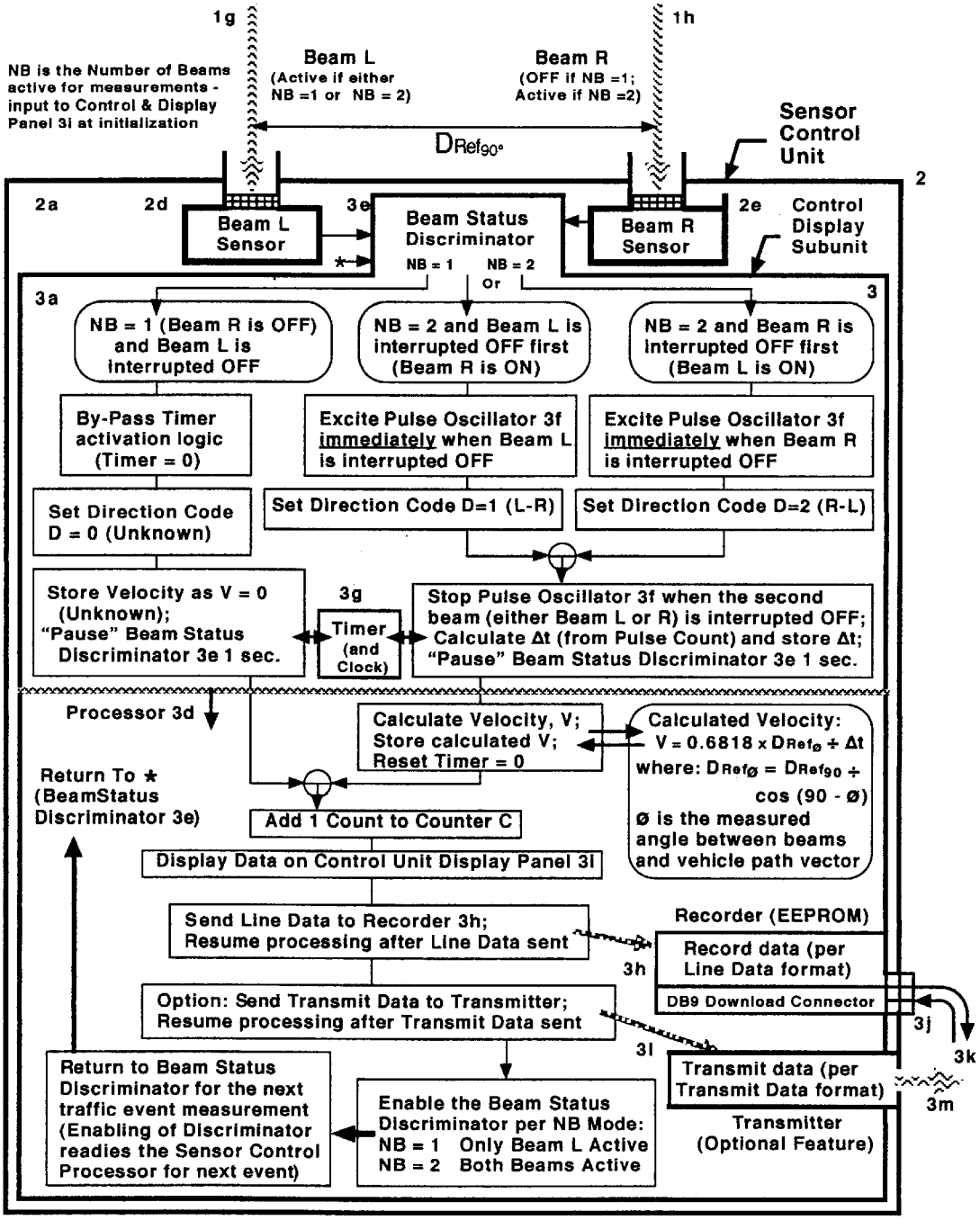
FIG. 7 schematically presents the preferred elements of the System Processor logic in the Optronic System for converting the raw sensed traffic signals (beam interruptions) into useful traffic data measurements (count of vehicles (C), velocity of each vehicle (V), and direction of travel (D)).

The logic flow and the processing steps which are used in generating, processing, displaying, recording and optionally transmitting the traffic measurements collected with the Optronic System is described hereafter. FIG. 7 also shows those logic paths and processing steps in graphical form. The logic for processing the sensed beam interruptions of the Light Beams 1*g* and 1*h* into traffic measurements follows one of two basic flow paths depending on the mode of operation of the Optronic System.

When only the count of traffic volume (C) is desired to be measured, the Optronic System will need only one light beam (the left Light Beam 1*g*) to be operative, and the Number of Beams (NB) to be entered through the Control & Display Panel 3*i* on the Control Display Subunit 3 at the time of the measurement system initialization will be entered by the installing technician as unity (NB=1). The logic used for this Count Only mode of operation is that each interruption of Light Beam 1*g* during a one second time increment will be counted as the passing of one vehicle (regardless of the number of axles on the vehicle, and regardless if there are other vehicles passing through the measurement "gate" at precisely the same time). The left Light Beam 1*g* interruption will be sensed by the left Beam Sensor 2*d*, and the normally ON electrical signal will be changed to OFF and passed from the Beam Sensor 2*d* to the Beam Status Discriminator 3*e*. With the NB set as 1, the Beam Status Discriminator 3*e* will cause the Control Display Micro Processor 3*d* to by-pass the logic to determine direction of the vehicle and the velocity of the vehicle, and the processing logic will "pause" further Beam Discriminator 3*e* signals for one second (using the Timer 3*g*) to allow the remaining axles of the vehicle (and any other co-passing vehicles) to pass through the system. At the end of the one second pause, the processing flow will then proceed directly to the adding of a unit count into the accumulating Counter logic on the Control Display Micro Processor 3*d* circuit board, and the Count (C) will be relayed to both the Data Recorder 3*h* and to the display portion of the Control & Display Panel 3*i*. The Control Display Micro Processor 3*d* will then pass the processing control back to the Beam Status Discriminator 3*e* for the next traffic event (i.e., the counting of another vehicle passing through the system).

When the Optronic System is installed and both Light Beams 1*g* and 1*h* are aligned to function in the two-beams (NB=2) mode, the logic to process the beam interruption signals into direction of vehicle travel (D) and velocity of the vehicle (V) is slightly more complex than that employed for only the counting (C) of the vehicles. When NB=2, the Beam Discriminator 3*e* will sense both Light Beams 1*g* and 1*h* interruptions in the sequence in which they are interrupted OFF. The logic for determining the vehicle direction of travel is simply that if the Left Light Beam 1*g* is interrupted before the Right Light Beam 1*h*, the direction of vehicle is determined as being from left to right (L-R, Direction Code D=1) relative to the face of the Sensor Control Unit 2. If the Right Light Beam 1*h* is interrupted before the Left Light Beam 1*g*, the direction of travel is determined as being from right to left (R-L, Direction Code D=2).

The logic in determining the velocity V of the passing vehicle is more computational than comparative, and is performed after one second following the second light beam interruption. The Beam Status Discriminator 3*e* initiates the Timer 3*g* to "pause" the Beam Status Discriminator 3*e* for one second to allow the vehicle being measured, and any other co-passing vehicles, to completely pass through the measurement "gate" without additional interruption signals. Immediately after the vehicle direction of travel has been determined, a determination is made by the Timer 3*g* of the number of pulses which the Pulse Oscillator 3*f* has performed during the time interval between the interruptions of the two Light Beams 1*g* and 1*h*, and that time interval ($\Delta t$, in milliseconds) is calculated and stored for subsequent use in a velocity computation. The Control Display Micro Processor 3*d* then performs the velocity computation using the equation from the Laws of Motion (described earlier in conjunction with Table 1), and uses the $\Delta t$ from immediately above, the $D_{Ref}$ (of 1 foot or that $D_{Ref}$ which is calculated should the installation angle of the light beams be other than orthogonal to traffic, as described for FIG. 5), and the conversion factor k (0.6818 mph/fps) to convert the resulting calculated velocity to V in miles per hour (mph). The processing flow then follows the same logic and flow path from the point where a unit count of the vehicle event is added into the accumulated vehicle Count (C), and the return of processing flow is returned to the Beam Status Discriminator 3*e* for the next vehicle passing traffic event.

An option to transmit data from the Optronic System Control Display Subunit 3 to a remote site arises from the optional inclusion of a Data Transmitter 3*l* within the Control Display Subunit 3. The Sensor Control Unit 2 and Control Display Subunit 3 perform their basic functions with or without the optional Data Transmitter 3*l*. Selected data transmitted to a law enforcement officer has obvious uses (e.g., when used as a more accurate substitute for stationary radar-type velocity measurements of speeding vehicles). For example, in a preferred embodiment of the invention, the Control & Display Panel 3*i* of the Optronic System enables a law enforcement officer to set a "Threshold Velocity" which if exceeded by a vehicle will cause the velocity and direction as well as date, time, location, etc., of the vehicle to be transmitted ahead to a remote location (for example, to a camera taking a photograph of the vehicle license plate number and of the driver's face). This photographic technique is currently in use by several cities as a means of identifying vehicle operators who "run" a red light signal at a dangerous intersection. The velocity of a vehicle may also be transmitted ahead to a mobile speed display unit to indicate to the vehicle operator the velocity measured when the vehicle passed through the Optronic System measurement beams.

Figure 8:
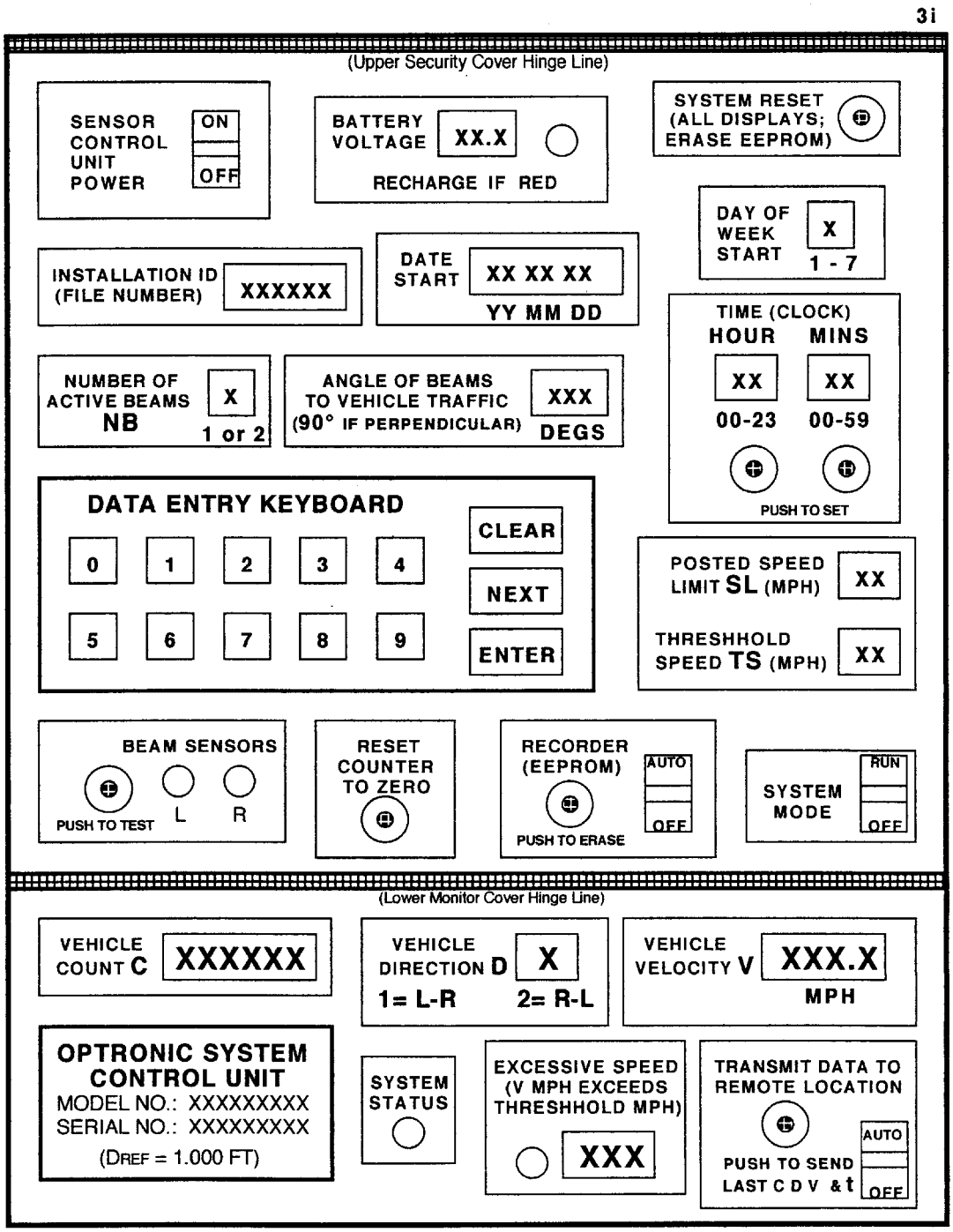
FIG. 8 schematically presents one embodiment of the interactive Control & Display Panel for the control and display functions on the upper face of the Control Display Subunit in the Optronic System, enabling the installing technician to interact with the controls and displays.

FIG. 8 is a preferred arrangement representation of the Control & Display Panel 3*i* located immediately below the top cover of the Control Display Subunit 3 in the Optronic System. The switches, display windows, test buttons, and status lights (red or green light emitting diodes, LEDs) are arranged generally in the order (starting at the top left of the Control & Display Panel 3*i*) as one reads a written page. The switches, windows, buttons, status lights, and displays provide the person installing and aligning the Optronic System with the means of control for activating and initializing the system, for identifying the measurements to be performed, for testing the functionality of the system after the system has been installed at a measurement location, for diagnosing installation errors, for monitoring the traffic data as it is being measured, for recording data at each set of individual vehicle measurements and at points of special interest, and for optionally causing the measured data to be transmitted to a remote location (e.g., to a camera or mobile speed display) for further use, such as by law enforcement officials.

Figure 9:
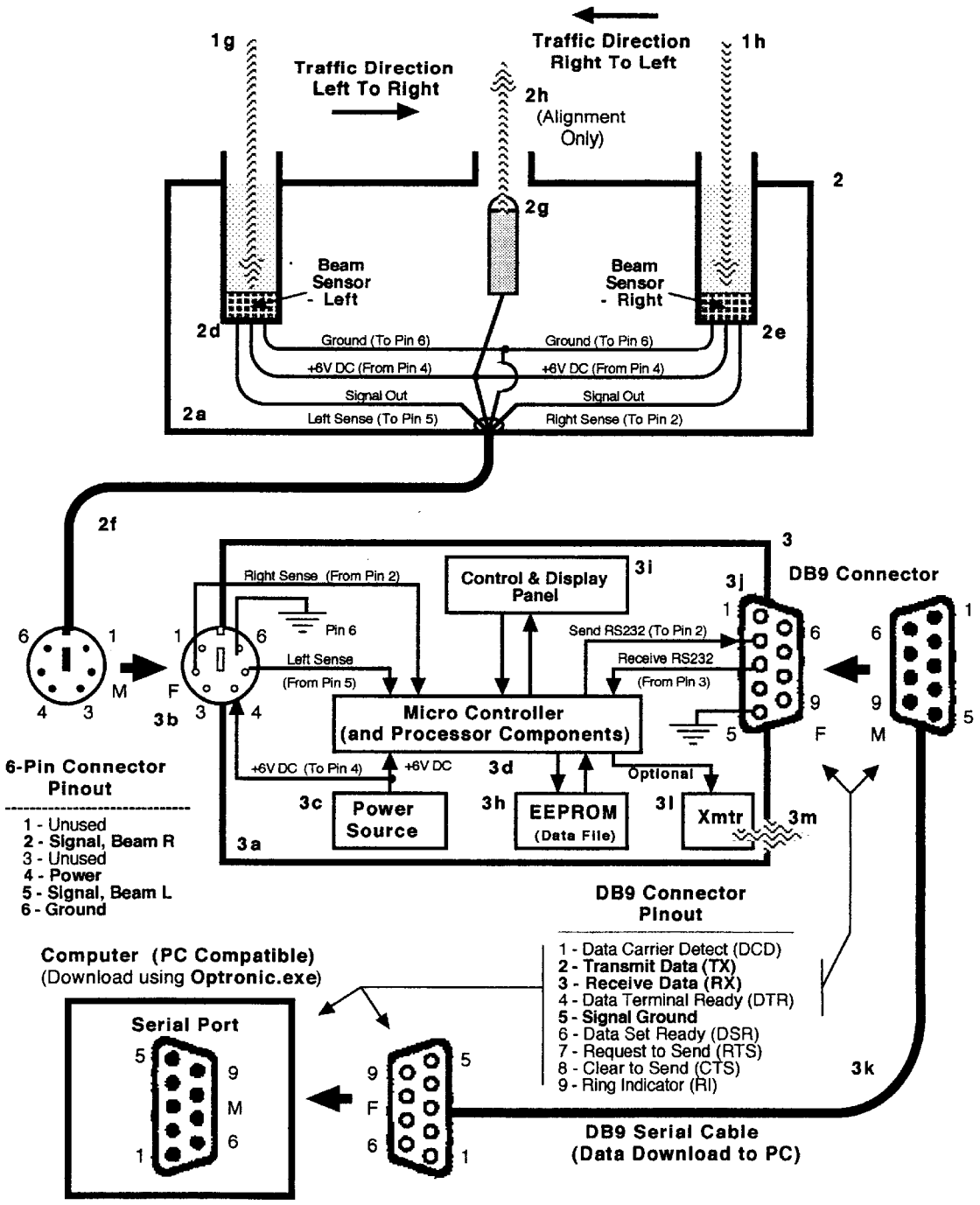
FIG. 9 schematically shows the preferred electrical wiring paths interconnecting the electrically-powered components of the Optronic System.

FIG. 9 shows the general arrangement of the wiring system within and between the elements and units in the Sensor Control Unit 2 which enables the sensing, processing, displaying, and downloading of the traffic measurements which can be made with the Optronic System. The electrical interfaces between the functional elements within the units comprising the Sensor Control Unit 2 are conducted through the wires within the units and wire cables between the units. The wiring components are standard state-of-the-art insulated wires and multi-strand wiring cables with connectors, and are of sufficient quality off-the-shelf to assure the accuracy of the electrical signals generated by sensors within the Optronic System.

In a preferred embodiment, the Sensor Control Unit 2 has the Control Display Subunit 3 in a detachable box so that it can be detached after the traffic measurement session is completed and taken to a computer facility for downloading of the traffic measurement data stored therein (on a standard EEPROM). The attachment interface is a standard Interconnect Cable 2*f* having a 6-pin male connector affixed on the free end which attaches to the female Input Connector 3*b* on the left side of the Control Display Subunit 3. (The embedded end of the cable separates into individual wires which are soldered onto the pins on the pair of photoelectric transistors in the Beam Sensor Unit 2 as shown in FIG. 4). The matching 6-pin female Input Connector 3*b* is assembled on the left side of the Control Display Subunit 3 as shown in FIG. 9 and, when connected, transmits the laser beam interrupt signals (from the Left and Right Beam Sensors 2*d* and 2*e* in the Sensor Control Unit 2) into the Control Display Subunit 3 for discernment and processing.

In a preferred embodiment, the length of the 6-pin Interconnect Cable 2*f* is approximately 12 feet long to allow the Control Display Subunit 3 to be remotely positioned from the Sensor Control Unit 2 (which will be near the side of a street surface). For example, the Sensor Control Unit 2 may be installed beneath a parked vehicle to conceal it from passing motorists, and a person optionally monitoring the traffic data being recorded and displayed may have the Control Display Subunit 3 with him/her in a parked vehicle.

Also, as shown in FIG. 9, the Control Display Subunit Download Connector 3*j* (a DB9 Connector (female)) is affixed on the side of the Control Display Subunit 3 which internally interfaces to the Data Recorder 3*h* through the Control Display Micro Processor 3*d*. When taken to a computer facility for downloading and further processing of the measured traffic data, a Download Interconnect Cable 3*k* (which is a standard DB9 serial cable, with standard 9-pin male-female connectors) is connected from the Control Display Subunit 3 to the Serial Port on a PC compatible computer. The necessary downloading program is available on a standard 1 MB floppy disk.

System Accuracy

The interruption of a laser light beam used in the Optronic System is discerned (by the Beam Status Discriminator 3*e*) as being virtually a "cut-off" signal traveling at the speed of light. The flat "face" (instantaneous cut-off time) of the first interrupted laser beam signal measured to the flat "face" of the second interrupted laser beam signal is able to be determined with essentially no "rise time". The accuracy of the Optronic System in determining a calculated vehicle velocity which is virtually identical to the actual vehicle velocity is also superior to that of measuring vehicle velocity by present radar-type instruments, which are prone to miscalibration and which often erroneously detect the velocity for false targets in the background of the prime target.

There are known sources of inaccuracy in the counting of vehicles, and in the measurement of vehicle velocity which are unavoidable with the Optronic System when the beams traverse a street and there are vehicles traveling in both directions through the beams. One primary source of inaccuracy is the uncommon occurrence of a vehicle interrupting a beam in one direction and a second vehicle traveling in the opposite direction interrupting the second beam before the first vehicle does so. The falsely shortened time increment At measured by the interruption of the two beams by two different vehicles will be discerned by the Optronic System as being caused by one vehicle traveling faster than its actual velocity.

One means of avoiding this source of inaccuracy is to emit the beams only across the lanes of traffic moving in the same direction and streets having a center island or median area offer this opportunity. If it is critical that the traffic measurements include data for vehicles moving in both directions during the same measurement time period, a second traffic measurement Optronic System may be installed across those lanes of the street having vehicular motion in the opposite direction.

To describe the accuracy of the Pulse Oscillator 3*f* pulse counting process, a conventional decimal (base 10) description of the arithmetic is provided, which is commonly easier to understand than using hexadecimal arithmetic. The accuracy of a Pulse Oscillator 3*f* in counting the total pulses for a vehicle traffic event is approximately ±3 pulses such that at an actual Δt of 0.1 seconds (62,500±3 pulses), the accuracy of the calculated time interval would be 0.1±0.000048 seconds. The corresponding calculated velocity (e.g. actual 6.818 mph for 0.1 seconds through a 1 foot reference distance) would be 6.818±0.0003272 mph. If the actual time for a vehicle to travel through the 1 foot reference distance (DREF) was accomplished in 0.01 seconds, there would be 6,250±3 pulses counted and the true velocity of 68.18 mph would be calculated as being 68.18±0.032726 mph. This level of high accuracy (less than ±0.04% inaccuracy) achievable with the present Optronic System invention in measuring the velocity of a moving vehicle is not achievable in the art of existing vehicle traffic measurement systems.

Several measurements of traffic in actual street environments were made using the Optronic System, and the resulting CDV data (Line Data) were tabulated and analyzed for accuracy and correctness. One such set of Line Data is printed in tabulation form as shown in Table 4. The vehicles measured during this measurement session were a mix of various length vehicles ranging from small size, two-axle passenger vehicles (with wheelbases all known to be between 98 and 113 inches) to medium size, three-axle trucks, some with a boat trailer being towed by the truck.

TABLE 4

| CNT | DIR | SPEED | TIME | DATE | PULSES | |
|---|---|---|---|---|---|---|
| 1 | L2R | 28.99242 | 20:27:33 | Jun. 06, 2000 | 050135 | |
| 2 | L2R | 13.01148 | 20:29:45 | Jun. 06, 1960 | 112150 | |
| 3 | L2R | 14.779 | 20:30:11 | Jun. 06, 2000 | 099031 | |
| 4 | R2L | 18.4874 | 20:30:77 | Jun. 06, 2000 | 079061 | |
| 5 | L2R | 38.62571 | 20:31:35 | Jun. 06, 2000 | 037237 | (40 mph accuracy check) |
| 6 | R2L | 16.8746 | 20:31:48 | Jun. 06, 2000 | 088098 | |
| 7 | L2R | 26.68364 | 20:33:19 | Jun. 06, 2000 | 055043 | |
| 8 | R2L | 33.29837 | 20:33:49 | Jun. 06, 2000 | 043255 | |
| 9 | R2L | 18.14042 | 20:34:41 | Jun. 06, 2000 | 080193 | |
| 10 | L2R | 9.489297 | 20:38:34 | Jun. 06, 2000 | 154096 | (10 mph accuracy check) |
| 11 | L2R | 17.47618 | 20:38:49 | Jun. 06, 2000 | 083212 | |
| 12 | L2R | 18.81846 | 20:37:32 | Jun. 06, 2000 | 094105 | |

The street widths where the measurements for Table 3 were made varied from approximately 70 feet wide to approximately 160 feet wide, and showed that the width of the street does not affect the operation or accuracy of the Optronic System. The street width may be more than 500 feet wide in terms of the distance through which the laser beams would travel from the Beam Emitter Unit 1 and still have sufficient light energy content to activate the photoelectric transistors of Beam Sensors 2*d* and 2*e* in the Sensor Control Unit 2. In general, the greater the distance between the Beam Emitter Unit 1 and the Sensor Control Unit 2 only requires finer adjustments in the adjustable Alignment Screwposts 1*k* and 2*k* to bring the components into proper mutual alignment. This should not be construed to mean that the Optronic System requires a calibration of any type (i.e., alignment of components does not constitute a calibration per se)—it does not. An important, but not a very detrimental, consideration of street width would become the number of lanes of traffic traveling in both directions in a very wide street measurement scenario. With multiple vehicles traveling in both directions through the region between the two beams, the probability of two vehicles interrupting the two beams from a different direction at nearly the same time is increased. This would cause an erroneous measurement of the time increment Δt between the interruption of the two beams for one of those vehicles, and the Optronic System would calculate an apparent velocity which is erroneous for whichever vehicle interrupted whichever of the beams first. Velocity calculations shown in the print-out of the data would likely be so very improbable (such as 140 mph in a 25 mph speed limit zone) that the traffic data shown in that line of data should be deleted or at least ignored in the traffic data analysis.

The traffic measurements made with the Optronic System were processed into accurate data descriptions of the traffic and motion of each of the measured vehicles. The data were downloaded using conventional computer procedures and converted into data print-outs as representative examples. More sophisticated data analysis routines (e.g., calculating and displaying the vehicle velocity spectrum during a selected time period and/or during the total measuring period, calculating and displaying the volume of traffic flow on a time-line basis, calculating and displaying the directional flow of traffic in a graphically animated manner for the time-setting of signal lights, etc.) may optionally be employed by traffic engineering and law enforcement personnel in large communities to suit their particular needs and computer resource capabilities and availabilities. The Optronic System provides them with the opportunity to do so.

A Data Transmitter 3*l* is optionally incorporated in the Optronic System. The transmittal (for example, by radio frequency (RF) or hard-wire means) of vehicle traffic code violations to remote locations (such as to a remote camera, to an existing mobile vehicle speed display, or to a law enforcement officer in a vehicle) is an optional feature.

It will be understood that the above described embodiments of the present invention are susceptible to various modifications, changes, and adaptations, and the same are intended to be comprehended within the meaning and range of equivalents of the appended claims. Further, although a number of equivalent components may have been mentioned herein which could be used in place of the components illustrated and described with reference to the described embodiment, this is not meant to be an exhaustive treatment of all the possible equivalents, nor to limit the invention defined by the claims to any particular equivalent or combination thereof. A person skilled in the art would realize that there may be other equivalent components presently known, or to be developed, which could be used within the spirit and scope of the invention defined by the claims.

What is claimed is:

1. An apparatus for measuring the speed, direction of travel and cumulative count of one or more moving vehicles in a stream of traffic comprising:

a. a beam emitter unit comprising at least two visible wavelength laser beam emitters wherein said laser beam emitters are mounted to generate two visible wavelength laser beams coplanar and parallel to each other and having a lateral separation distance between said laser beams of approximately one foot; and b. a beam sensor unit comprising:

i. at least two laser beam sensors wherein said laser beam sensors are mounted to receive and distinguish the on/off status of said laser beams; and ii. a beam status discriminator and a timer means for electronically pausing said beam status discriminator and electrical processing for a one second period after said status of said laser beams is interrupted off;

wherein said beam emitter unit and said beam sensor unit are each positioned to emanate said laser beams between about 4–8 inches above the surface of a roadway.

2. An apparatus according to claim 1 wherein said beam emitter unit comprises:

a. a first visible wavelength laser beam emitter;

b. a second visible wavelength laser beam emitter; and c. a third visible wavelength laser beam emitter means for aligning said visible wavelength laser beams between said beam emitter unit and said beam sensor control unit.

3. A method of cumulatively counting a plurality of moving vehicles in a stream of traffic comprising the steps of:

providing an apparatus of claim 1;

interrupting either of two said visible wavelength laser beams generated across a roadway and sensed by said apparatus of claim 1 and electronically recording the sensed laser beam interruption;

processing the sequence and timing of the electronic events corresponding to said laser beam interruption via an electronic computer processor chip into a cumulative count of said moving vehicles; and producing an electronic data readout in chronological sequence from said apparatus.

4. A method of determining the speed and direction of travel of one or more moving vehicles in a stream of traffic comprising the steps of:

providing an apparatus of claim 1;

interrupting a first visible wavelength laser beam generated by said apparatus of claim 1 and electronically recording said first laser beam interruption;

interrupting a second visible wavelength laser beam generated by said apparatus of claim 1 and electronically recording said second laser beam interruption;

processing the electronic events corresponding to the sequence of and the time interval between said first and second laser beam interruptions via an electronic computer processor chip into the vehicle direction of travel and vehicle speed; and producing an electronic data readout in chronological sequence from said apparatus.

* * * * *